US008224015B2

(12) United States Patent
Ikeda et al.

(10) Patent No.: US 8,224,015 B2
(45) Date of Patent: Jul. 17, 2012

(54) SPEAKER, VOICE COIL UNIT, AND METHOD OF MANUFACTURING THE VOICE COIL UNIT

(75) Inventors: Emiko Ikeda, Tokyo (JP); Takahisa Tagami, Kanagawa (JP)

(73) Assignee: Sony Corporation, Tokyo (JP)

( * ) Notice: Subject to any disclaimer, the term of this patent is extended or adjusted under 35 U.S.C. 154(b) by 536 days.

(21) Appl. No.: 12/422,599

(22) Filed: Apr. 13, 2009

(65) Prior Publication Data

US 2009/0257617 A1 Oct. 15, 2009

(30) Foreign Application Priority Data

Apr. 15, 2008 (JP) ..... 2008-106179

(51) Int. Cl.
*H04R 11/02* (2006.01)

(52) U.S. Cl. ..... 381/396

(58) Field of Classification Search ..... 381/396
See application file for complete search history.

(56) References Cited

U.S. PATENT DOCUMENTS

| | | | | |
|---|---|---|---|---|
| 2002/0039430 | A1* | 4/2002 | Nakaso | 381/396 |
| 2007/0025585 | A1* | 2/2007 | Ikeda et al. | 381/403 |
| 2007/0076915 | A1 | 4/2007 | Shin et al. | |
| 2007/0081693 | A1* | 4/2007 | Andersen et al. | 381/423 |
| 2007/0165902 | A1* | 7/2007 | Matsumura et al. | 381/396 |
| 2008/0063234 | A1* | 3/2008 | Watanabe | 381/405 |
| 2008/0205686 | A1* | 8/2008 | Tagami et al. | 381/398 |

FOREIGN PATENT DOCUMENTS

| | | | |
|---|---|---|---|
| EP | 1950998 | A1 | 1/2008 |
| JP | 37-000217 | Y | 7/1934 |
| JP | 57-021200 | A | 2/1982 |
| JP | 10-191494 | A | 7/1998 |
| JP | 2002-176693 | A | 6/2002 |
| JP | 2002-223495 | | 8/2002 |
| JP | 2002-223496 | | 8/2002 |
| JP | 2002-262389 | | 9/2002 |
| JP | 2003-032789 | A | 1/2003 |
| JP | 2007-513567 | A | 5/2007 |

* cited by examiner

*Primary Examiner* — Charles Garber
*Assistant Examiner* — Andre' C Stevenson
(74) *Attorney, Agent, or Firm* — Wolf, Greenfield & Sacks, P.C.

(57) ABSTRACT

A speaker includes a magnetic circuit forming a slit-like magnetic gap, a frame that houses and holds the magnetic circuit, a diaphragm attached to the frame so as to be capable of vibrating, a voice coil unit that is placed so as to pass through substantially the center of the magnetic gap, and has its one end coupled to the diaphragm, and a damper attached to the frame to support the other end of the voice coil unit. The voice coil unit has a planar-type coil bobbin section, and a voice coil section having a coil member wound in a planar track shape and disposed so as to extend through the coil bobbin section from one side to the other side and from the other side to the one side.

6 Claims, 17 Drawing Sheets

SPEAKER, VOICE COIL UNIT, AND METHOD OF MANUFACTURING THE VOICE COIL UNIT

CROSS REFERENCES TO RELATED APPLICATIONS

The present invention contains subject matter related to Japanese Patent Application JP 2008-106179 filed in the Japanese Patent Office on Apr. 15, 2008 the entire contents of which are incorporated herein by reference.

BACKGROUND OF THE INVENTION

1. Field of the Invention

The present invention relates to a speaker, a voice coil unit, and a method of manufacturing the voice coil unit, which can be applied to a slim-type speaker for liquid crystal televisions, PDP televisions, home audio devices, desktop and notebook personal computers, and the like. More specifically, the present invention relates to a speaker, a voice coil unit, and a method of manufacturing the voice coil unit, in which a voice coil section is provided, the voice coil section having a coil member wound in a planar track shape so as to extend through a planar-type coil bobbin section from one side to the other side and from the other side to the one side, and which makes it possible to reduce thermal deformation due to a bimetal phenomenon resulting from a difference between the thermal expansion coefficient of the coil member and the thermal expansion coefficient of the coil bobbin member, and maintain the planarity of the coil bobbin member.

2. Description of the Related Art

In recent years, with the proliferation of slim-type televisions using a liquid crystal display device or plasma display device (PDP), there is a demand for thin-type and slim-type speakers and the like. Examples of the shape of the voice coil for realizing thin-type and slim-type speakers range from a common cylindrical shape to a planar shape.

In connection with a planar-type speaker of this kind, Japanese Unexamined Patent Application Publication No. 2002-223495 discloses a slim-type speaker that can be used in various audio devices and video devices. This speaker includes a magnetic circuit, a frame, a diaphragm, a damper, and a voice coil, and a slit-like magnetic gap is provided in the magnetic circuit. The frame is coupled to this magnetic circuit. The outer peripheral edges of the diaphragm are coupled to the frame. The planar voice coil is coupled to the diaphragm and passed through the magnetic gap of the magnetic circuit, and is supported by the damper coupled to the magnetic circuit. In this speaker, the damper is provided with a through-hole, and a part or the whole of the lower portion of the voice coil is inserted into this through-hole, thereby coupling the damper and the voice coil together. When the speaker is configured in this way, a highly reliable speaker that delivers deep bass and high input tolerance can be provided.

SUMMARY OF THE INVENTION

Since the slim-type speaker according to the related art adopts a planar-type voice coil structure, there are the following problems.

i. The planar-type voice coil structure adopts a structure in which a voice coil member is affixed onto one side of a planar-type coil bobbin material. This structure does not provide much strength due to the geometry involved in comparison to the cylindrical-type voice coil structure, giving rise to frequent occurrence of thermal deformation due to a bimetal phenomenon that results from a difference in thermal expansion coefficient between the bobbin material and the coil member. A bimetal phenomenon refers to a phenomenon in which, due to a difference between the thermal expansion coefficient of a coil member and the thermal expansion coefficient of a coil bobbin member, in a structure obtained by affixing these two members together, the coil bobbin member warps toward the side where the coil member having a higher thermal expansion coefficient is affixed.

ii. It was confirmed that the thermal deformation due to the bimetal phenomenon described above gives rise to increased occurrence of such problems as rubbing of the coil member against the magnetic gaps, and peeling between the bobbin member and the coil member. It is thus feared that it may become difficult to maintain the input tolerance of the slim-type speaker.

It is thus desirable to provide a speaker, a voice coil unit, and a method of manufacturing the voice coil unit, which make it possible to prevent rubbing of the coil member within the magnetic gaps and peeling of the coil member, and improve the input tolerance.

Although a voice coil bobbin usually refers to one having a cylindrical shape, in this specification, following common practice, one having a planar shape is also referred to as "bobbin".

According to an embodiment of the present invention, there is provided a speaker including a magnetic circuit forming a slit-like magnetic gap, a frame that houses and holds the magnetic circuit, a diaphragm attached to the frame so as to be capable of vibrating, a voice coil unit that is placed so as to pass through substantially the center of the magnetic gap, and has its one end coupled to the diaphragm, and a damper attached to the frame to support the other end of the voice coil unit. The voice coil unit has a planar-type coil bobbin section, and a voice coil section having a coil member wound in a planar track shape and disposed so as to extend through the coil bobbin section from one side to the other side and from the other side to the one side.

The speaker according to the above-mentioned embodiment includes a voice coil unit that is placed so as to pass through substantially the center of the magnetic gap, and has its one end coupled to the diaphragm. The voice coil unit has a planar-type coil bobbin section, and a voice coil section having a coil member wound in a planar track shape and disposed so as to extend through the coil bobbin section from one side to the other side and from the other side to the one side.

According to this configuration, thermal deformation due to the bimetal phenomenon that results from a difference between the thermal expansion coefficient of the coil member and the thermal expansion coefficient of the coil bobbin member can be cancelled out between one side and the other side of the coil member, thereby making it possible to maintain the planarity of the coil bobbin member. Thus, rubbing of the coil member within the magnetic gaps, and peeling of the coil member can be prevented, allowing for an improvement in input tolerance.

According to an embodiment of the present invention, there is provided a voice coil unit including a planar-type coil bobbin section, and a voice coil section having a coil member wound in a planar track shape and disposed so as to extend through the coil bobbin section from one side to the other side and from the other side to the one side.

The voice coil unit according to the above-mentioned embodiment has a voice coil section having a coil member wound in a planar track shape and disposed so as to extend through the coil bobbin section from one side to the other side and from the other side to the one side.

According to this configuration, thermal deformation due to the bimetal phenomenon that results from a difference between the thermal expansion coefficient of the coil member and the thermal expansion coefficient of the coil bobbin member can be cancelled out between one side and the other side of the coil member, thereby making it possible to maintain the planarity of the coil bobbin member. Thus, rubbing of the coil member within the magnetic gaps, and peeling of the coil member can be prevented, allowing for an improvement in input tolerance.

According to an embodiment of the present invention, there is provided a method of manufacturing a voice coil unit including the steps of forming a planar-type coil bobbin section, and forming a voice coil section by winding a coil member in a planar track shape so as to extend through the coil bobbin section from one side to the other side and from the other side to the one side.

According to the method of manufacturing a voice coil unit according to the above-mentioned embodiment, a voice coil section is formed by winding a coil member in a planar track shape so as to extend through the coil bobbin section from one side to the other side and from the other side to the one side. Thus, rubbing of the coil member within the magnetic gaps, and peeling of the coil member can be prevented, allowing for an improvement in input tolerance.

BRIEF DESCRIPTION OF THE DRAWINGS

FIG. 5 is a top view showing an example of thermal deformation of the voice coil unit shown in FIG. 3B, the voice coil unit shown in FIG. 4, or the like;

DESCRIPTION OF THE PREFERRED EMBODIMENTS

Hereinbelow, a speaker, a voice coil unit, and a method of manufacturing the voice coil unit according to an embodiment of the present invention will be described with reference to the drawings.

Figure 1:
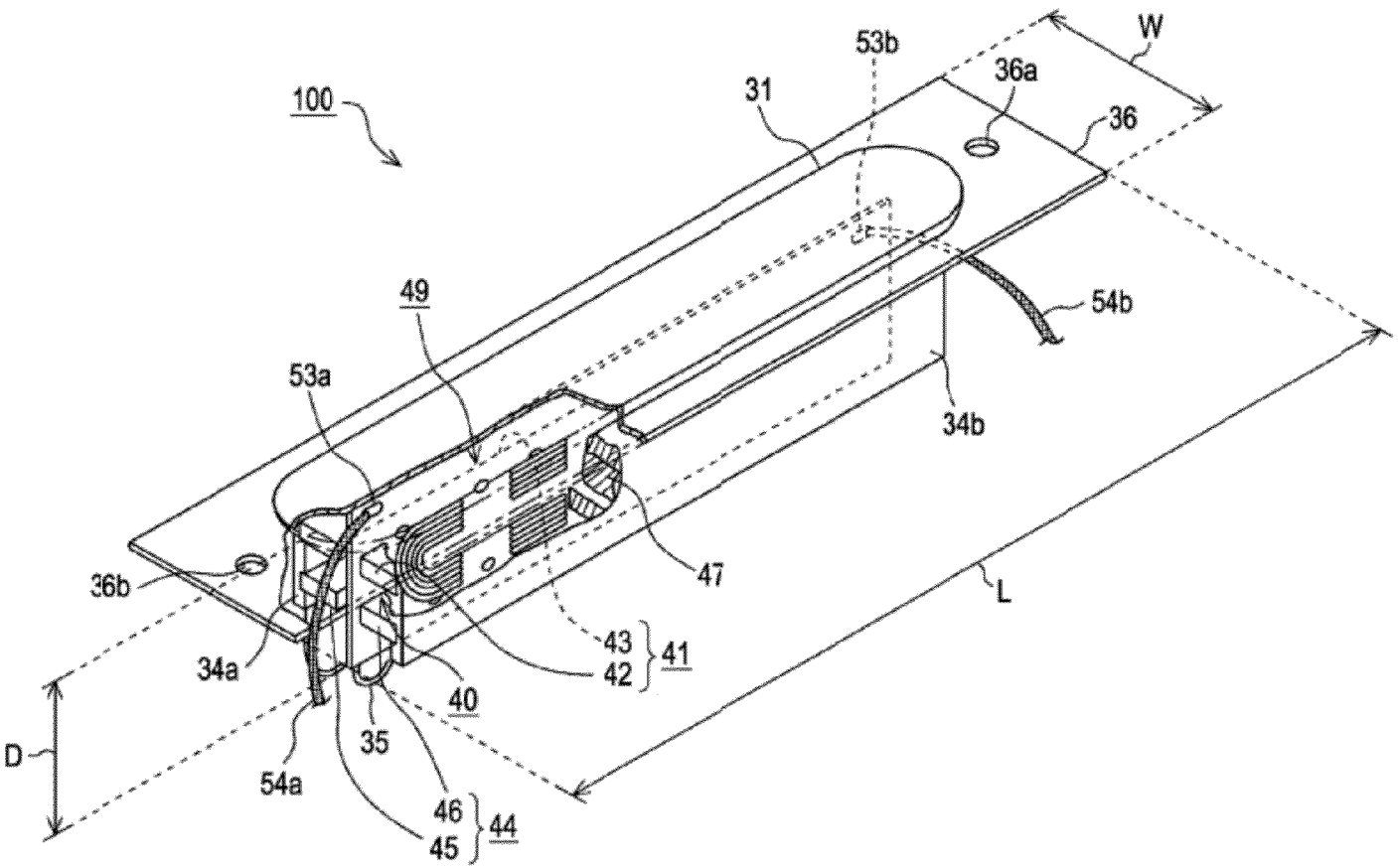
FIG. 1 is a perspective view showing a configuration example of a speaker according to an embodiment of the present invention.
Figure 2:
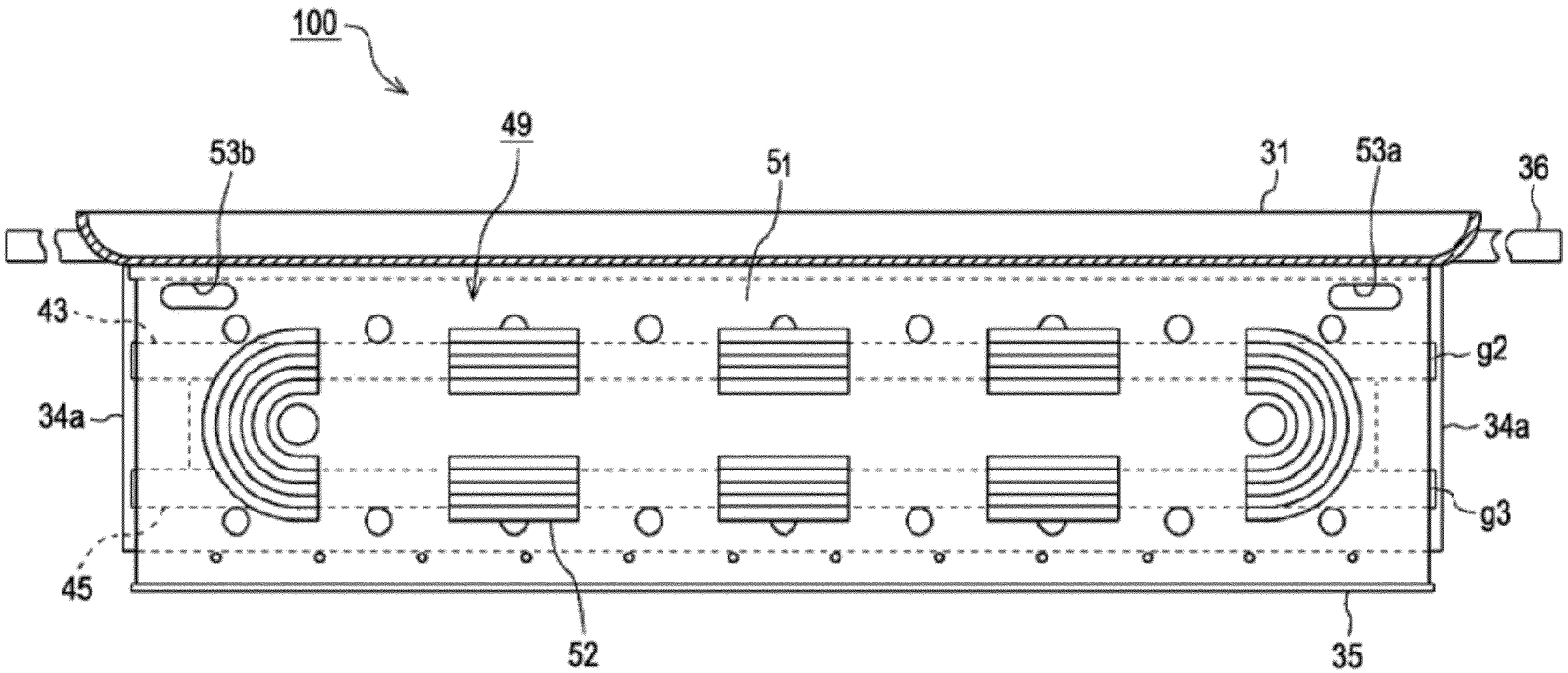
FIG. 2 is an enlarged view showing a configuration example of the cross section of the speaker.

FIG. 1 is a perspective view showing a configuration example of a speaker 100 according to an embodiment of the present invention. FIG. 2 is an enlarged view showing a configuration example of the cross section of the speaker 100. The speaker 100 shown in FIG. 1 can be applied to a slim-type speaker for liquid crystal televisions, plasma display (PDP) televisions, home audio devices, desktop and notebook personal computers, and the like. The size of the speaker 100 is, for example, about 14 mm in width W, 108 mm in height H, and 21 mm in depth D. The speaker 100 has a baffle board 36. The speaker 100 is attached to a predetermined stand or the casing of a liquid crystal television or the like with screws (not shown) via screw holes 36*a* and 36*b* bored at predetermined positions of the baffle board 36.

The speaker 100 includes, in addition to the baffle board 36, a diaphragm 31, left and right frames 34*a* and 34*b*, a damper 35, a magnetic circuit 40, and a voice coil unit 49. In the speaker 100, the diaphragm 31 is attached to the baffle board 36 so as to be capable of vibrating in its front-rear direction. The baffle board 36 has at its central position an opening 36*c* (see FIG. 6) that is somewhat smaller than the diaphragm 31 that is elongated and narrow as a whole. In addition, a magnetic circuit 40 with twin straight gaps is placed inside the frames 34*a* and 34*b* provided on opposite sides of the baffle board 36. Slit-like magnetic gaps g2 and g3 (see FIG. 4) are provided in the magnetic circuit 40. The frames 34*a* and 34*b* houses and holds the magnetic circuit 40. The diaphragm 31 is attached to the frames 34*a* and 34*b* via edges. The voice coil unit 49 is placed so as to pass through substantially the center of the magnetic gaps g2 and g3, and is coupled to the diaphragm 31 at its one end.

The magnetic circuit 40 has an upper plate 41 and a lower plate 44. Between the upper plate 41 and the lower plate 44, for example, neodymium magnets (hereinafter, simply referred to as magnets) 47 and 48 (see FIG. 7) with a high maximum energy product are attached in a parallel fashion at a predetermined spacing from each other. This makes it possible to obtain a necessary magnetic flux density effectively by the thin, small magnets 47 and 48 in the magnetic circuit 40. In this regard, the maximum energy product is a measure of the performance of a magnet at which the product of a residual magnetic flux density (Br) and a coercivity (HC) becomes maximum.

The upper plate 41 includes an upper right plate 42 and an upper left plate 43, and the lower plate 44 includes a lower left plate 45 and a lower right plate 46. In the magnetic circuit 40, the slit-like gap formed between the upper right plate 42 and the upper left plate 43 in the upper plate 41 is used as the magnetic gap g2 defined by the magnets 47 and 48. In addition, the slit-like gap formed between the lower left plate 45 and the lower right plate 46 in the lower plate 44 is used as the magnetic gap g3.

The magnetic 47 is polarized (in this case, the upper side is the S pole, and the lower side is the N pole) in a state such that the magnet 47 is attached and fixed at a predetermined position on the lower right plate 46 having a linear shape, and then the upper right plate 42 of the same size and shape as the lower right plate 46 is attached and fixed to the magnet 47 in an overlapping manner. The magnet 48 is polarized (in this case, the upper side is the N pole, and the lower side is the S pole) in a state such that the magnet 48 is attached and fixed at a predetermined position on the lower left plate 45 so as to be opposed to the magnet 47 on the lower right plate 46, and then the left right plate 43 of the same size and shape as the lower left plate 45 is attached and fixed to the magnet 48 in a an overlapping manner.

In the thus attached state, the side surface of the lower left plate 45 and the side surface of the upper left plate 43 are joined via the frame 34*a*, and the side surface of the upper right plate 42 and the side surface of the lower right plate 46 are joined via the frame 34*b*. This forms the magnetic circuit 40 having the magnetic gap g2 in which a magnetic flux is generated so as to flow from the upper left plate 43 to the upper right plate 42, and the magnetic gap g3 in which a magnetic flux is generated so as to flow from the lower left plate 45 to the lower right plate 46.

Figure 7:
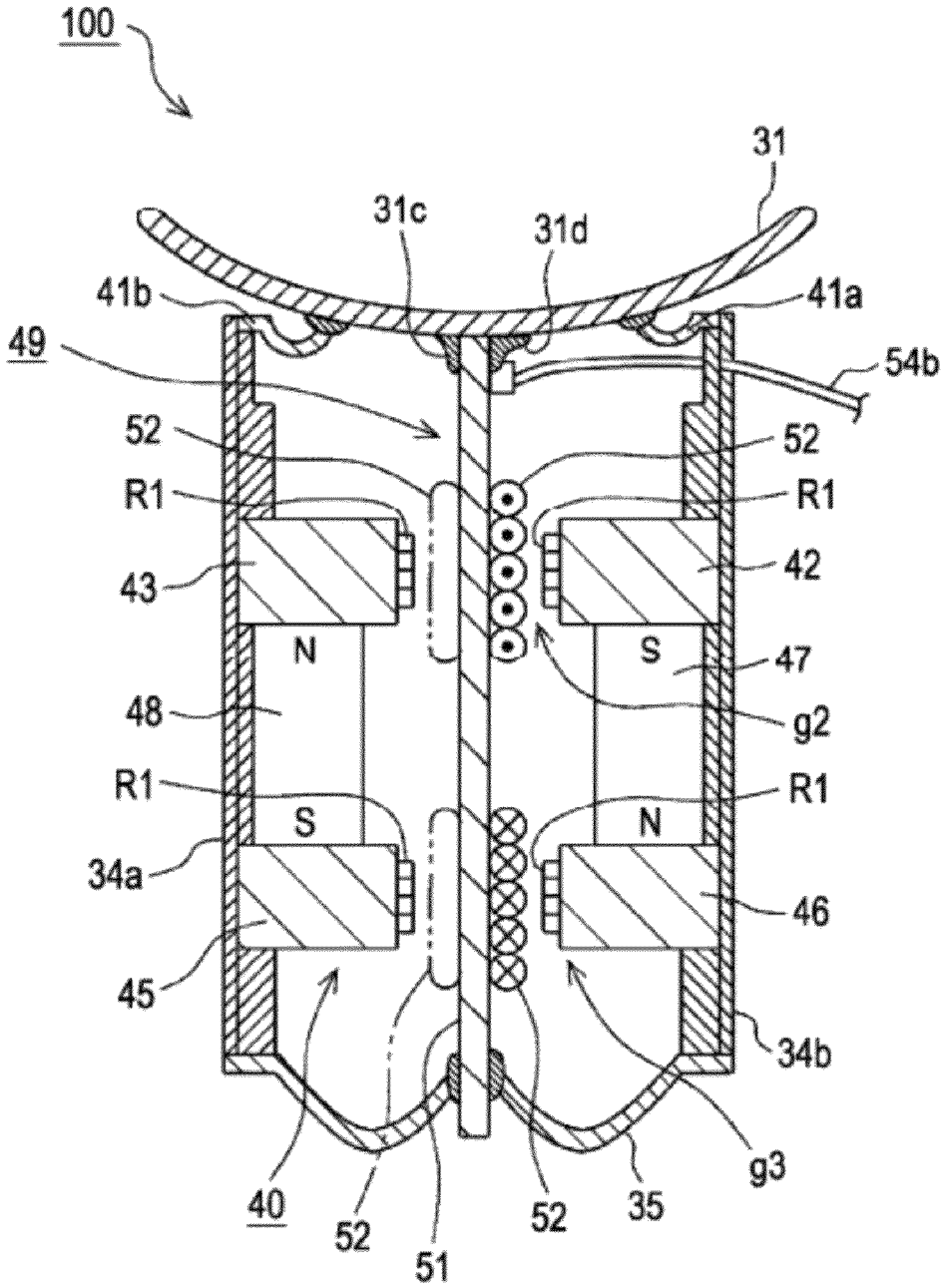
FIG. 7 is a cross-sectional view showing an assembly example (2) of the speaker.

As shown in FIG. 2, the cross-sectional structure of the slim-type speaker 100 using the magnetic circuit 40 described above is such that the planar-type voice coil unit 49 is placed between the magnetic gaps g2 and g3 of the magnetic circuit 40 that is attached inside the frames 34*a* and 34*b* (see FIG. 7).

The voice coil unit 49 includes a planar-type rectangular bobbin section 51, and a voice coil section 52 having a planar track shape. The rectangular bobbin section 51 is an example of the function of a coil bobbin section, and is formed from, for example, a polyimide film in the form of a thin, flat sheet. As the material of the rectangular bobbin section 51, in addition to a polyimide film, a polyamide nonwoven fabric, a woven glass fabric base, a polyimide-impregnated sheet, aluminum, brass, heat resistant Kraft, a mica sheet, or the like is used.

The rectangular bobbin section 51 is provided with terminals 53*a* and 53*b*. One end of a coil member of the voice coil section 52 is connected to the terminal 53*a*. The other end of the coil member is connected to the terminal 53*b*. A lead-out tinsel wire 54*a* is connected to the terminal 53*a*, and a tinsel wire 54*b* is similarly connected to the terminal 53*b*. For each of the tinsel wires 54*a* and 54*b*, a meshed copper wire is used.

Figure 3A:
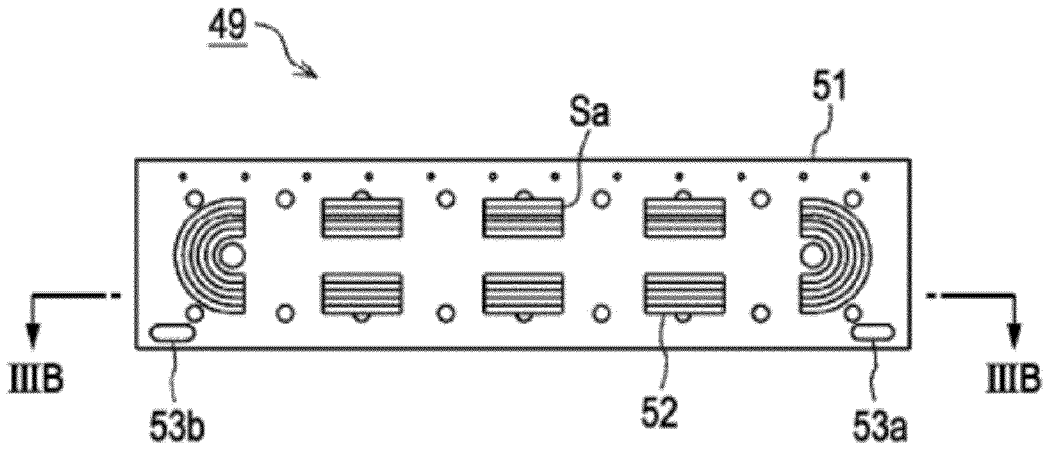
FIGS. 3A and 3B are respectively a front view showing a configuration example of a voice coil unit, and a cross-sectional view taken along the arrow IIIB-IIIB thereof.
Figure 3B:
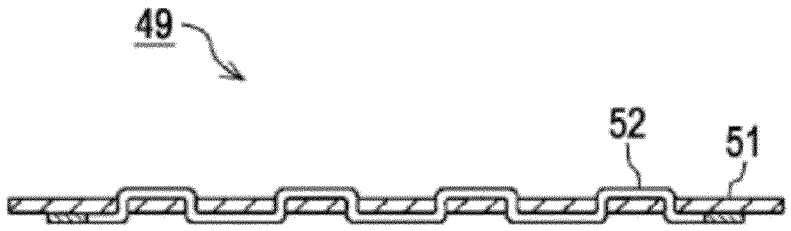

FIGS. 3A and 3B are a front view showing a configuration example of the voice coil unit 49, and a cross-sectional view taken along the arrow IIIB-IIIB. The planar-type voice coil unit 49 shown in FIG. 3A is extracted from the speaker 10. The voice coil section 52 shown in FIG. 3A has the coil member wound in a flat track shape and disposed so as to extend through the rectangular bobbin section 51 from one side to the other side and from the other side to the one side. For example, a plurality of slits are provided in the rectangular bobbin section 51, and the voice coil section 52 is disposed so as to weave alternately in and out of the slits from one side to the other side of the rectangular bobbin section 51 as shown in FIG. 3B (see FIG. 10C).

Figure 4:
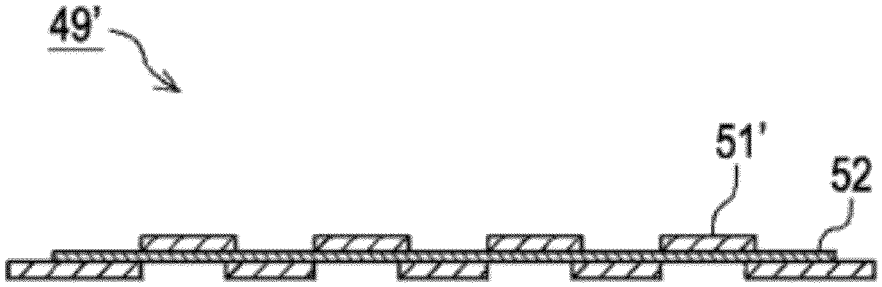
FIG. 4 is a cross-sectional view showing a configuration example of another voice coil unit.

FIG. 4 is a cross-sectional view showing a configuration example of another voice coil unit 49'. The voice coil unit 49' shown in FIG. 4 is of a type in which slits that provides enhanced ease of insertion are provided in a rectangular bobbin section 51', and the voice coil section 52 is inserted into these slits. For example, a plurality of slits having a U shape are provided alternately on the front and back of the rectangular bobbin section 51', and the voice coil section 52 are passed so as to be alternately inserted into the U-shaped slits. With this configuration of the voice coil unit 49', the planarity or flatness of the voice coil section 52 relative to the planarity or flatness of the rectangular bobbin section 51' can be maintained.

Figure 5:
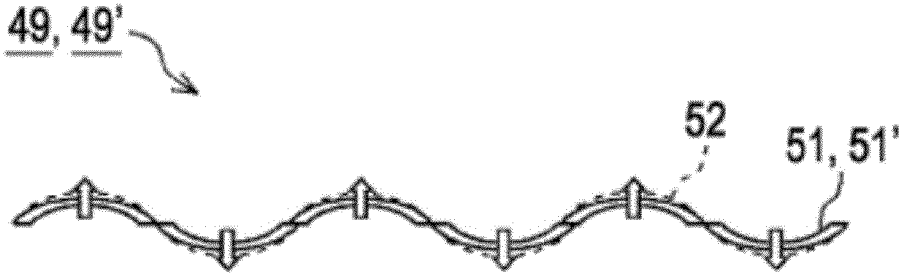

Now, referring to FIG. 5, a description will be given of an example of the structural function of the planar-type voice coil unit 49, 49' or the like. FIG. 5 is a top view showing an example of thermal deformation of the voice coil unit 49 shown in FIG. 3B, the voice coil unit 49' shown in FIG. 4, or the like.

In this example, since the voice coil unit 49, 49' or the like is placed so as to pass through substantially the center of the magnetic gaps g2 and g3 of the magnetic circuit 40 shown in FIG. 1, and is coupled to the diaphragm 31 at its one end, the voice coil unit 49, 49' or the like preferably has planarity and flatness.

In the example of the structural function of the planar-type voice coil unit 49, 49' or the like shown in FIG. 5, the circular thick line represents the rectangular bobbin section 51, 51', and the circular broken line represents the voice coil section 52. In the drawing, each upwardly pointing arrow indicates a thermal deformation part where the voice coil unit 49 or the like warps from a lower part to an upper part, and each downwardly pointing arrow indicates a thermal deformation part where the voice coil unit 49 or the like warps from an upper part to a lower part. Such a thermal deformation part is considered to be produced due to a bimetal phenomenon resulting from a difference between the thermal expansion coefficient of the coil member and the thermal expansion coefficient of the bobbin member. The thermal expansion coefficients of the bobbin member and coil member are shown in Table 1.

TABLE 1

| Material | Thermal Expansion Coefficient [ppm/° C.] |
|---|---|
| Aluminum | 23 |
| Copper | 17 |
| Iron | 12 |
| PC | 0.0007 |
| PP | 0.0008 |
| PE | 0.0013 |

According to Table 1, iron, aluminum, and copper that form the coil member have large thermal expansion coefficients, ranging from 12 to 23. In contrast, polycarbonate (PC), polypropylene (PP), and polyethylene (PE) that form the bobbin member have small thermal expansion coefficients, ranging from 0.0007 to 0.0013.

According to the planar-type voice coil unit 49 or the like, unlike in the cylindrical-type voice coil structure of the related art, there is no butting portion for the cylindrical body. Thus, it is necessary to maintain the planarity and flatness of the voice coil unit 49 or the like by minimizing thermal deformation that occurs during operation due to a difference in thermal expansion coefficient (Table 1) between the bobbin member and the coil member that are made of different materials. In this example, while the planar cantilevered-type voice coil unit of the related art is subject to large thermal deformation in one direction, in the system according to the embodiment of the present invention, thermal deformation can be distributed across multiple locations as shown in FIG. 5. Further, the thermal deformation part indicated by the upwardly pointing arrow where the voice coil unit 49 or the like warps from a lower part to an upper part, and the thermal deformation part indicated by the downwardly pointing arrow where the voice coil unit 49 or the like warps from an upper part to a lower part can be cancelled out by each other between one and the other sides of the rectangular bobbin section 51.

Figure 6:
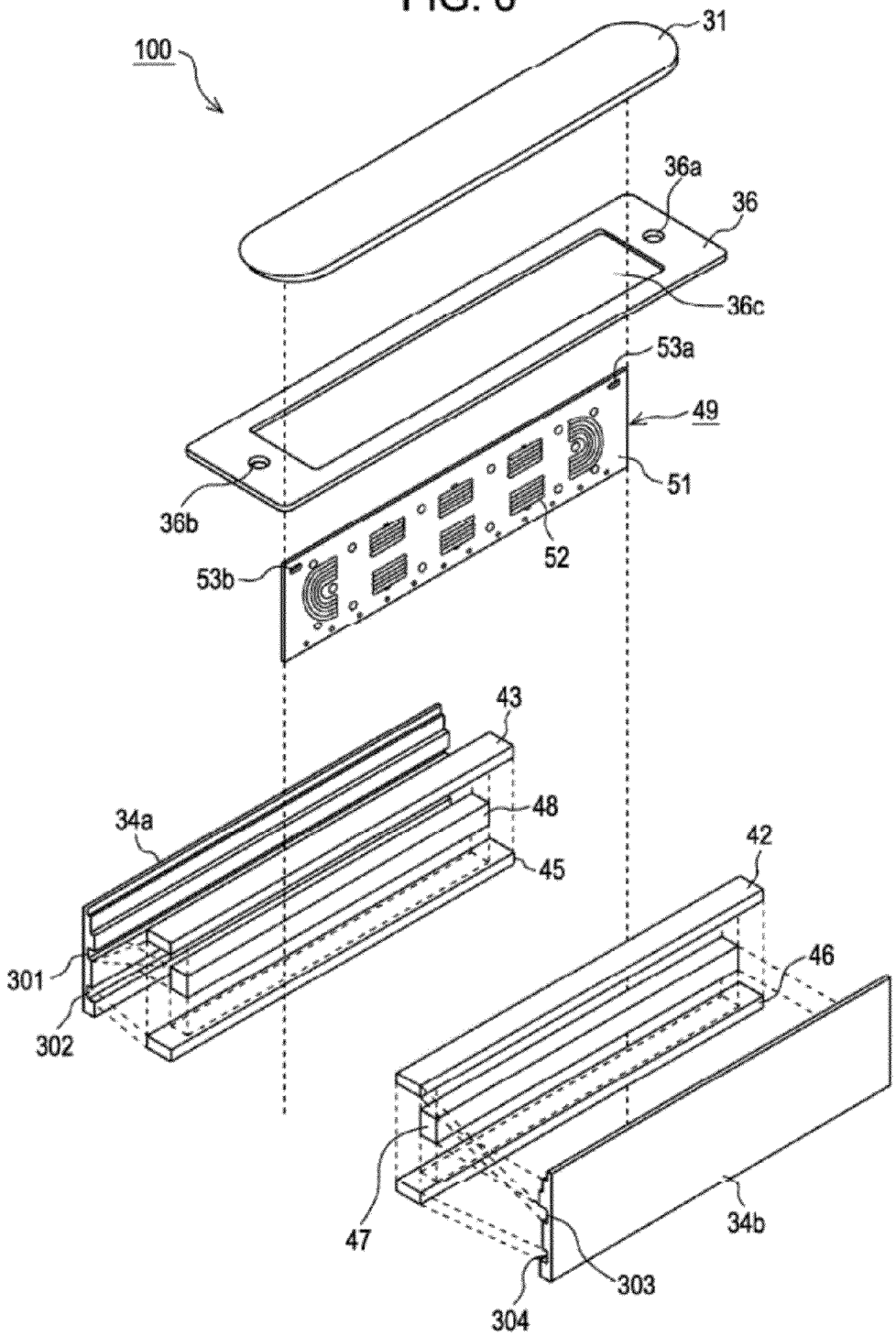
FIG. 6 is an exploded perspective view showing an assembly example (1) of the speaker.

FIG. 6 is an exploded perspective view showing an assembly example (1) of the speaker 100, and FIG. 7 is a cross-sectional view showing an assembly example (2) thereof. In FIG. 6, first, the diaphragm 31 and the voice coil unit 49 are attached. The diaphragm 31 used is formed of, for example, a foamed mica material of an elongated ship-like shape that is slightly concave on its front side, and has two rail-like projections 31*c* and 31*d* provided at the central portion on its back side (see FIG. 7).

The distance between the projections 31*c* and 31*d* of the diaphragm 31 is substantially equal to the thickness of the voice coil unit 49. The voice coil unit 49 is bonded with an adhesive to the diaphragm 31 with its cone part facing downward, in such a way that the rectangular bobbin section 51 lies along the vertical direction. At this time, the projections 31*c* and 31*d* are used for the positioning of the upper end portion of the voice coil unit 49 and the central portion of the diaphragm 31, and the voice coil unit 49 is securely attached and fixed in place in a state with the upper end portion of the voice coil unit 49 inserted in between the projections 31*c* and 31*d*. The voice coil unit 49 used may be a voice coil unit 492, 493 shown in FIGS. 13A through 17, other than the one shown in FIG. 3A.

It is preferable that the frames 34*a* and 34*b* used have plate-engaging grooves 301 to 304. The upper left plate 43, the lower left plate 45, and the magnet 48 are attached to the frame 34*a*. The magnet 48 is sandwiched by the upper left plate 43 and the lower left plate 45 and is fixed with an adhesive. At this time, one end of the upper left plate 43 is fitted in the groove 301 of the frame 34*a*, and one end of the lower left plate 45 is fitted in the groove 302 of the frame 34*a*. The magnet 48 is placed in such a way that its N pole faces the upper left plate 43.

Likewise, the upper right plate 42, the lower right plate 46, and the magnet 47 are attached to the frame 34*b*. The magnet 47 is sandwiched by the upper right plate 42 and the lower right plate 46 and is fixed with an adhesive. One end of the upper right plate 42 is fitted in the groove 303 of the frame 34*b*. One end of the lower right plate 46 is fitted in the groove 304 of the frame 34*b*. The magnet 47 is placed in such a way that its N pole faces the upper right plate 42.

Further, in a state in which the voice coil unit 49 attached with the diaphragm 31 is inserted in the opening 36*c* of the baffle board 36, while maintaining the magnetic gaps g2 and g3, the voice coil unit 49 is sandwiched by the frame 34*a* to which the upper left plate 43, the lower left plate 45, and the magnet 48 have been attached, and the frame 34*b* to which the upper right plate 42, the lower right plate 46, and the magnet 47 have been attached, and the respective distal ends of the frames 34*a* and 34*b* are attached to the baffle board 36. At this time, a magnetic fluid R1 is disposed in each of the magnetic gaps g2 and g3.

Then, the damper 35 in a roll shape as shown in FIG. 7 is attached. In this example, to support the other end of the voice coil unit 49, the damper 35 is attached to the lower end portion of each of the frames 34*a* and 34*b*. For example, the voice coil unit 49 is attached in a state with its upper end portion abutted on substantially the central portion of the diaphragm 31, is attached to the damper 35 in a state with the lower end portion of the voice coil unit 49 extending through the central portion of the roll-shaped damper 35 attached to the lower end portion of each of the frames 34*a* and 34*b*, is movable in the front-rear direction indicated by the arrow between the magnetic gaps g2 and g3.

As shown in FIG. 7, the damper 35 stably supports the voice coil drive 49 inside the magnetic gaps g2 and g3 of the magnetic circuit 40. As the material of the damper 35, one obtained by hot forming of a woven fabric impregnated with thermosetting resin such as phenolic resin, a butterfly damper obtained by punching a Bakelite panel, or a butterfly damper made of injection molding resin is used. As the shape of the damper 35, to allow following of the reciprocating motion in the front-rear direction, it is desirable to employ a corrugated shape formed by a series of waves, a roll shape, or the like.

In this example, the damper 35 has a substantially M-shaped cross section, and has at its substantially central portion an elongated through-hole (not shown) allowing passage of the lower end portion of the rectangular bobbin section 51 of the voice coil unit 49. The damper 35 is attached in a state with the lower end portion of the rectangular bobbin section 51 projecting slightly from the through-hole.

Further, edges 41*a* and 41*b* are attached to the bottom surface of the diaphragm 31 and the respective upper ends of the frames 34*a* and 34*b*. The diaphragm 31 is attached to the frames 34*a* and 34*b* via the edges 41*a* and 41*b*. In particular, the back side of the diaphragm 31 and the edges 41*a* and 41*b* are attached to each other in a state with the front side of the diaphragm 31 facing outward. Thus, as compared with a case where the diaphragm 31 is attached in a state with the edges 41*a* and 41*b* exposed to the outside, a larger surface area can be secured for the diaphragm 31, thus providing enhanced bass characteristics.

Also, the so-called magnetic fluid R1 is sealed in the magnetic gap g2 between the upper right plate 42 and the upper left plate 43, and in the magnetic gap g3 between the lower left plate 45 and the lower right plate 46. This achieves an improvement in stability of vibration of the voice coil unit 49, an improvement in density of magnetic fluxes J1 and J2, and an improvement in heat dissipation characteristics of the voice coil section 52.

Here, the magnetic fluid R1 refers to a liquid that is formed of magnetic particles (for example, iron oxide) with a particle size of about 10.0 [m] (100 Å), a surface-active agent, and a base liquid, and reacts with a magnet having a high magnetic permeability. The magnetic fluid R1 is a stable colloid solution in which no flocculation of magnetic particles takes place, by making the surface-active agent be adsorbed on the surface of the magnetic particles. As the base liquid, water, hydrocarbon oil, ester oil, fluorine oil, or the like is used while taking the intended application and usage environment into consideration.

The magnetic fluid R1 has a characteristic such that although it is a fluid with no magnetic properties when there is zero magnetic field, the magnetic fluid R1 is magnetized upon exertion of a magnetic field from the outside, and its magnetization is lost upon removing the magnetic field exerted from the outside. By utilizing this characteristic, the voice coil unit 49 can be held at the center of the magnetic gaps g2 and g3. The slim-type speaker 100 as shown in FIG. 1 is thus completed.

Figure 8:
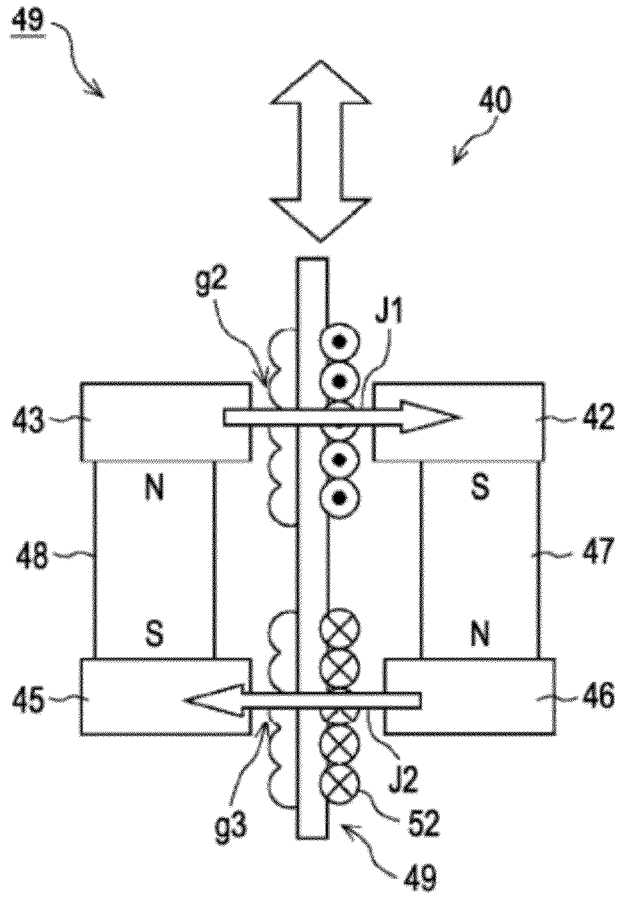
FIG. 8 is an explanatory view showing an operation example of the voice coil unit according to the speaker.

FIG. 8 is an explanatory view showing an operational example of the voice coil unit 49 of the speaker 100. The voice coil unit 49 shown in FIG. 8 is configured such that when placed between the magnetic gaps g2 and g3 of the magnetic circuit 40, the voice coil unit 49 is susceptible to the magnetic flux J1 within the magnetic gap g2 and the magnetic flux J2 within the magnetic gap g3, and that, upon passage of a current through the voice coil section 52, in accordance with the Fleming's left hand rule, a drive force for causing the voice coil unit 49 to reciprocate in the front-rear direction indicated by the thick arrow in which the diaphragm 31 (not shown) oscillates can be generated within the magnetic gaps g2 and g3.

In practice, in the speaker 100, when, in a state with the voice coil unit 49 placed in the magnetic fluid R1 within the magnetic gaps g2 and g3 of the magnetic circuit 40 shown in FIG. 7, an external force is applied so as to cause the voice coil unit 49 to be displaced from the center of the magnetic gaps g1 and g2, an amount of magnetic fluid R1 corresponding to the applied force is pushed out and moved in a predetermined direction. However, in the speaker 100, since the magnetic fluid R1 that has been moved has a property of moving toward the stronger magnetic field on the lower left plate 46 side, the magnetic fluid R1 that has been moved returns in the opposite direction, thus allowing the voice coil unit 49 to be held at the center of the magnetic gaps g2 and g3 again.

Therefore, in the speaker 100, the voice coil unit 49 is held at the center of the magnetic gaps g2 and g3 at all times not only by the damper 35 but also by the centering action exerted by the magnetic fluid R1. This makes it doubly possible to prevent the voice coil unit 49 from being displaced to the left or right from the center of the magnetic gaps g2 and g3 to come into contact with the upper right plate 42, the upper left plate 43, the lower left plate 45, and the lower right plate 46.

As described above, the speaker 100 according to the above-mentioned embodiment includes the voice coil unit 49 that is placed so as to pass through substantially the center of the magnetic gaps g2 and g3, and is coupled to the diaphragm 31 at its one end. The voice coil unit 49 has the voice coil section 52 having the coil member wound in a planar track shape and disposed so as to extend through the rectangular bobbin section 51 having the plurality of slits from one side to the other side and from the other side to the one side.

Since thermal deformation due to the bimetal phenomenon that results from a difference between the thermal expansion coefficient of the coil member and the thermal expansion coefficient of the rectangular bobbin section 51 can be cancelled out between one side and the other side of the rectangular bobbin section 51, the planarity of the rectangular bobbin section 51 can be maintained. Thus, rubbing of the coil member within the magnetic gaps, and peeling of the coil member can be prevented, thus allowing for an improvement in input tolerance.

Next, a method of manufacturing the voice coil unit 49 according to an embodiment of the present invention will be describe with reference to FIGS. 9 to 12.

Embodiment 1

Figure 9:
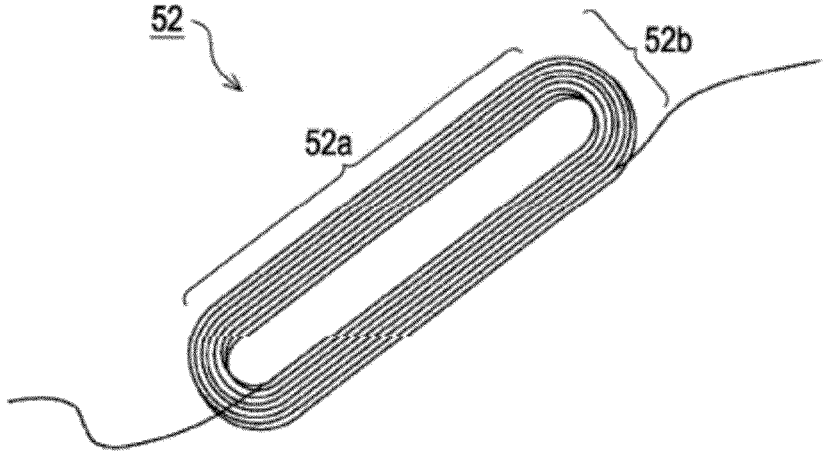
FIG. 9 is a perspective view showing a formation example of a voice coil section according to each embodiment.

FIG. 9 is a perspective view showing a formation example of the voice coil section 52 according to each embodiment. This embodiment is based on the assumption that, instead of the cylindrical voice coil structure according to the related art, the planar-type voice coil unit 49 that can be mounted on the slim-type speaker 100 shown in FIG. 1 is formed.

As shown in FIG. 9, first, the voice coil section 52 having a planar track shape is formed. For example, a coil member such as an enamel-coated insulated copper wire is wound in a planar track shape to form the voice coil section 52. The desired track shape of the voice coil section 52 is such that a linear section 52*a* along each of the two longitudinal sides is formed long, and a curved section 52*b* is formed short in conformity with the rectangular bobbin section 51. Thereafter, the voice coil section 52 is fired in order to fix the planar track shape. Thus, the voice coil section 52 having a planar track shape can be fabricated.

Figure 10A:
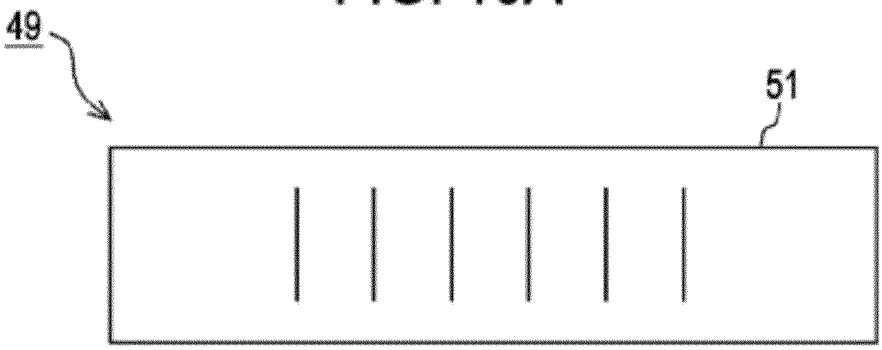
FIGS. 10A to 10C are each a process drawing showing a formation example (1) of the voice coil unit according to a first embodiment.
Figure 10B:
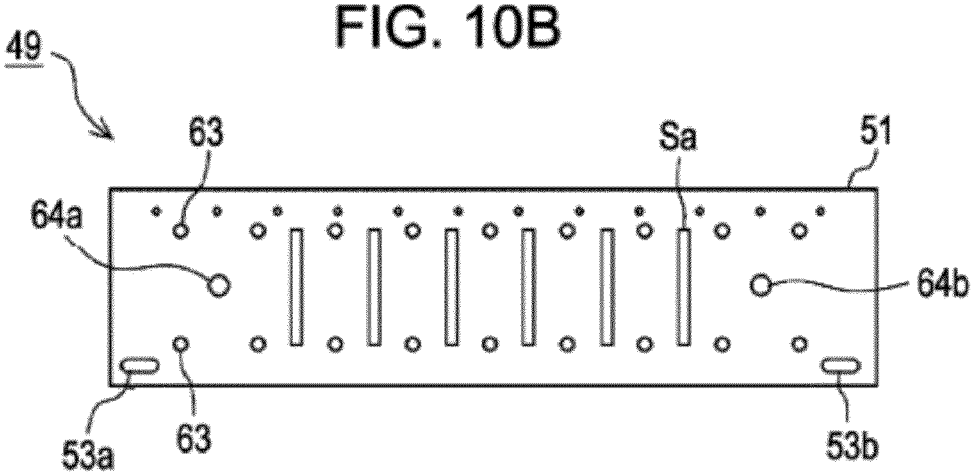
Figure 10C:
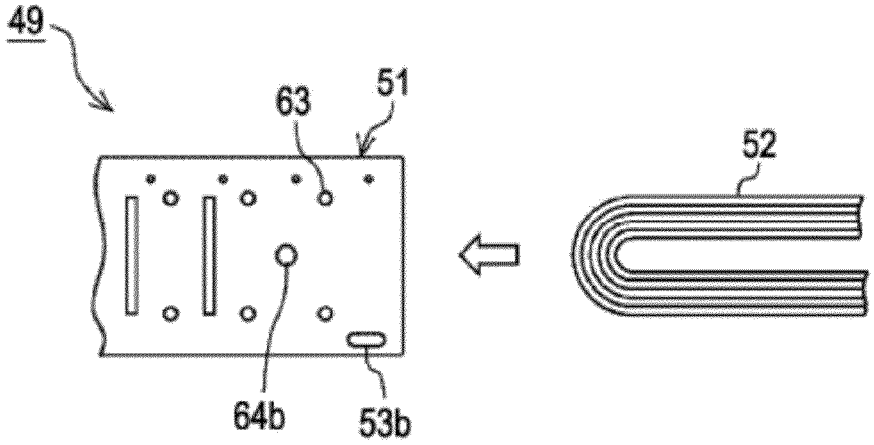
Figure 11:
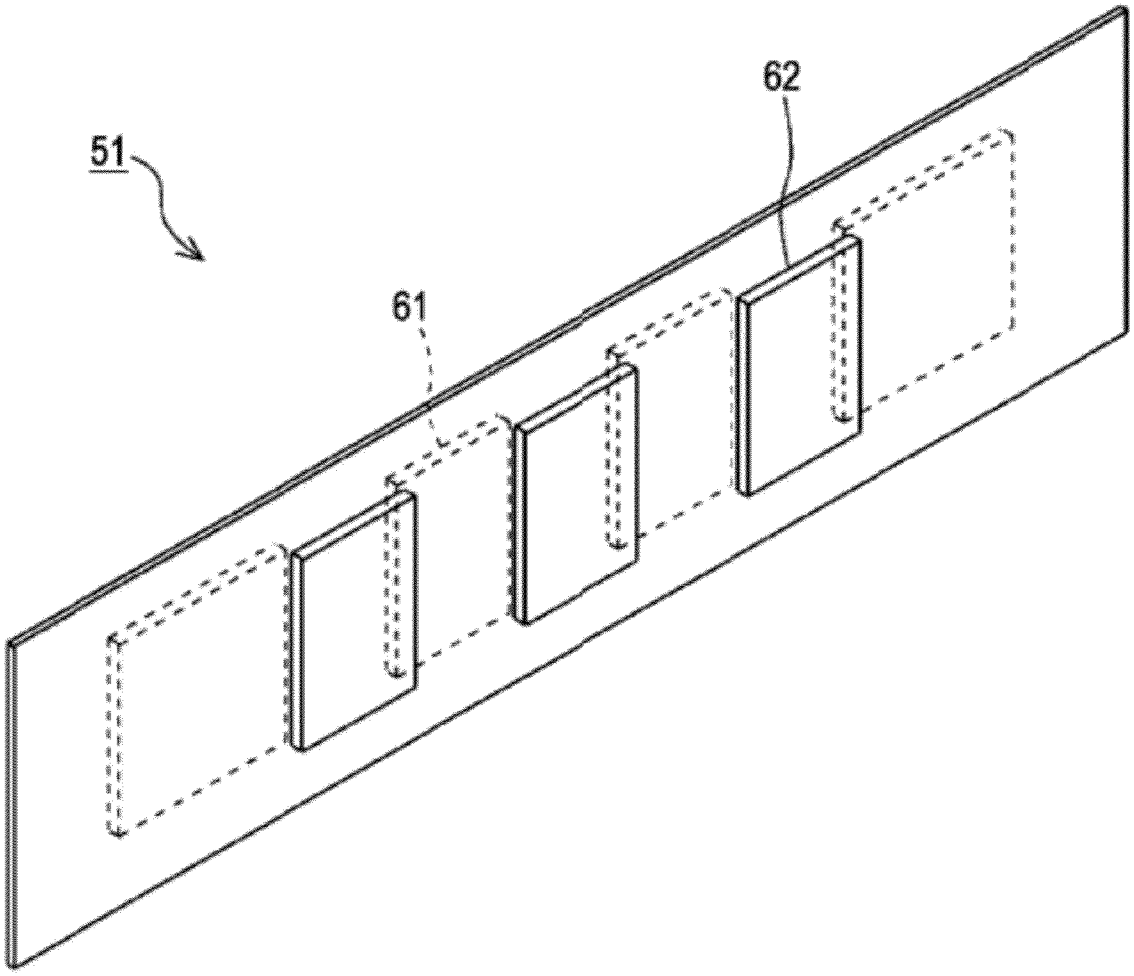
FIG. 11 is a perspective view showing a configuration example of a rectangular bobbin section.
Figure 12:
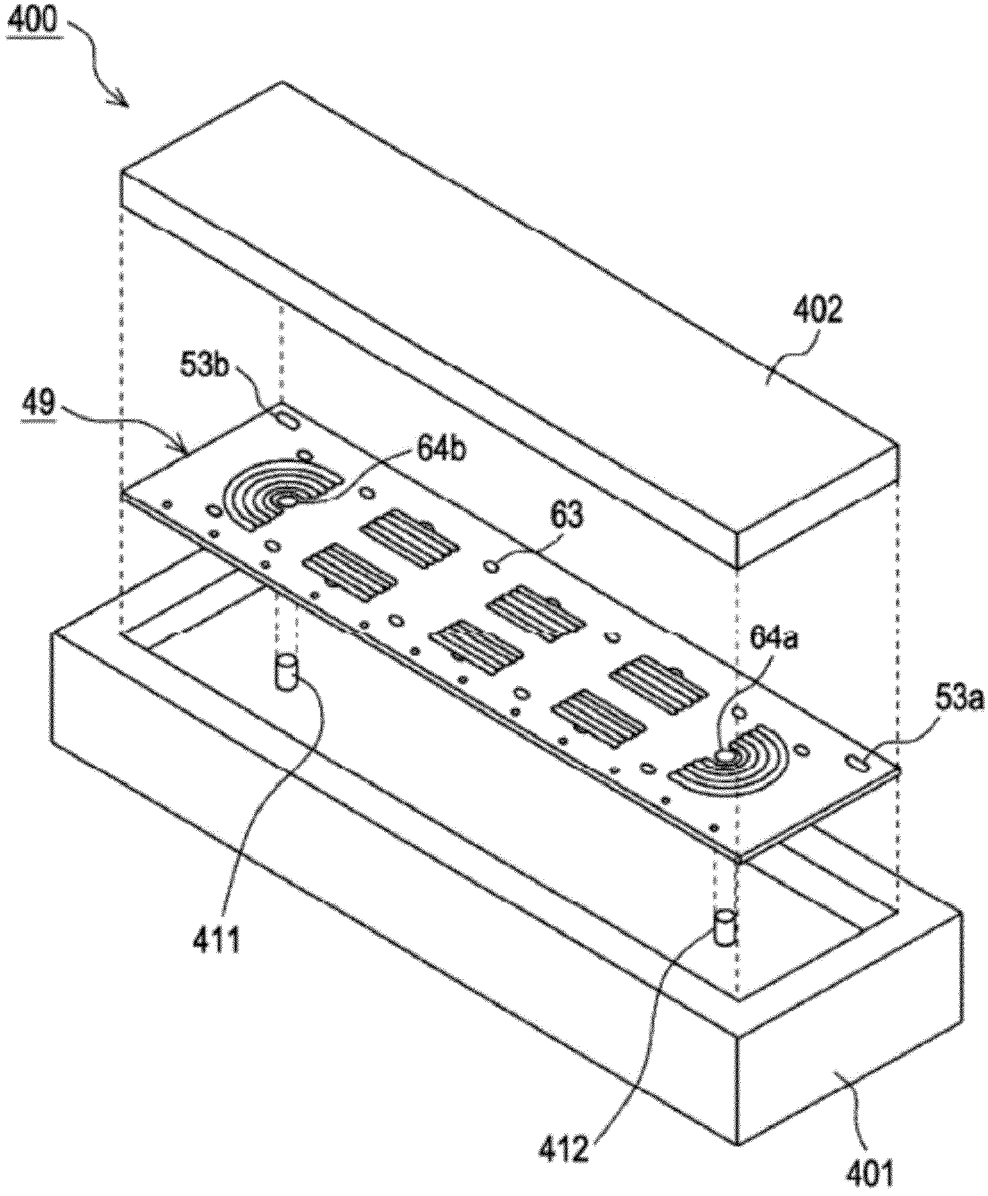
FIG. 12 is a structural view showing a formation example (2) of the voice coil unit.

FIGS. 10A to 10C are each a process drawing showing a formation example (1) of the voice coil unit 49 according to a first embodiment. FIG. 11 is a perspective view showing a configuration example of the rectangular bobbin section 51. FIG. 12 is a structural view showing a formation example (2) of the voice coil unit 49.

In this example, once the voice coil section 52 shown in FIG. 9 is successfully fabricated, the rectangular bobbin section 51 shown in FIG. 10A is formed. Although the rectangular bobbin section 51 may simply have slits cut in a bobbin member, it is preferable to fabricate and use the rectangular bobbin section 51 having an irregular shape as shown in FIG. 11, for example.

The rectangular bobbin section 51 having an irregular shape mentioned above is formed in such a way that a bobbin member made of sheet-like polycarbonate or the like is extrusion molded, and projecting portions are formed on the front and back, thereby increasing the strength of the rectangular bobbin section 51 itself. Each stepped portion due to the extrusion molding serves as a part where the voice coil section 52 is made to cross the rectangular bobbin section 51. In this example, the rectangular bobbin section 51 has projections 61 and depressions 62 as shown in FIG. 11. The steps formed by the projections 61 and the depressions 62 are set smaller than or equal to the wire diameter of the voice coil section 52 shown in FIG. 9.

Next, the bobbin member is punched to form the rectangular bobbin section 51 as shown in FIG. 10B. At this time, a plurality of long, narrow rectangular slits Sa, a plurality of joining through-holes 63, and coil-positioning holes 64*a* and 64*b*, and further, lead-out terminals 53*a* and 53*b* are formed in the bobbin member. In this example, the number of the slits Sa is six. Of course, the number of the slits Sa may be increased to eight in total by adding one more slit Sa on either side. The slits Sa are bored so as to be orthogonal to the longitudinal direction of the rectangular bobbin section 51.

The holes 64*a* and 64*b* are preferably bored in alignment with substantially the center position of the curved portion of the voice coil section 52. In this example, the rectangular bobbin section 51 has nine through-holes 63 formed in vertical rows at positions that overlap the points where the voice coil section 52 having a planar track shape is bonded. The terminals 53*a* and 53*b* are each formed by, for example, affixing a copper foil cut out in a track (elongate hole) shape with an adhesive.

The through-holes 63 are formed in such a way that upon positioning and bonding the voice coil section 52 having a planar track shape, the linear portion of the voice coil section 52 and the through-holes 63 are opposed to each other. With this configuration, by passing the adhesive through the through-holes 63 to be exposed on the front and back, the fixation of the adhesive after curing can be improved.

Once the above-described rectangular bobbin section 51 is successfully formed, the voice coil section 52 shown in FIG. 10C is disposed so as to weave alternately through the rectangular bobbin section 51. As the voice coil section 52, one formed from a single winding track shown in FIG. 9 and having a coil member wound in a planar track shape is used. In the above-described example, the voice coil unit 49 is formed by disposing the voice coil section 52 so as to weave alternately through the rectangular bobbin section 51. In this regard, since the steps formed by the depressions 61 and the projections 62 are set smaller than the wire diameter of the voice coil section 52, bonding is done in a state with the voice coil section 52 protruding slightly from the surface of the rectangular bobbin section 51. At this time, the voice coil section 52 and the rectangular bobbin section 51 are joined together in such a way that the adhesive passes through the front and back by using the plurality of through-holes 63.

Thereafter, the voice coil unit 49 is placed into a mold clamping jig 400 shown in FIG. 12. The mold clamping jig 400*b* includes a recessed, closed-bottom main body section 401 and a weight lid section 402. The main body section 401 used has positioning protrusions 411 and 412 on its inner side. The hole 64*a* in the voice coil unit 49 is fitted onto the protrusion 411, and the hole 64*b* is fitted onto the protrusion 412.

In this state, the weight lid section 402 is closed from above the main body section 401. The voice coil unit 49 is clamp-molded between the weight lid section 402 and the recessed, closed-bottom main body section 401, followed by heat treatment. Thereafter, the mold clamping jig 400 is cooled, and the voice coil unit 49 is cured. Thus, the voice coil section 52 is wound so as to extend through the rectangular bobbin section 51 from one side to the other side and from the other side to the one side, and the coil member can be affixed to both sides of the rectangular bobbin section 51 alternately. Then, by using the terminals 53*a* and 53*b* of the rectangular bobbin section 51, a meshed tinsel wire is soldered onto the coil member of the voice coil section 52 (wire treatment). The voice coil unit 49 is thus completed.

In this way, with the voice coil unit 49 and its manufacturing method according to the first embodiment, the voice coil unit 49 is provided which is placed so as to pass through substantially the center of the magnetic gaps g2 and g3 and is coupled to the diaphragm 31 at its one end. The voice coil unit 49 has the voice coil section 52 having a coil member wound in a planar track shape and disposed so as to extend through the rectangular bobbin section 51 from one side to the other side and from the other side to the one side.

Therefore, thermal deformation due to the bimetal phenomenon that results from a difference between the thermal expansion coefficient of the coil member and the thermal expansion coefficient of the rectangular bobbin section 51 can be cancelled out between one side and the other side of the rectangular bobbin section 51, thereby making it possible to maintain the planarity of the rectangular bobbin section 51. Thus, since the rectangular bobbin section 51 is pulled not from one side but alternately from both sides due to thermal expansion, there is a relatively small amount of deformation, and there is less peeling or less rubbing of the voice coil section 52 within the magnetic gaps g2 and g3, leading to an improvement in the input tolerance of the planar-type voice coil unit 49.

Embodiment 2

Figure 13A:
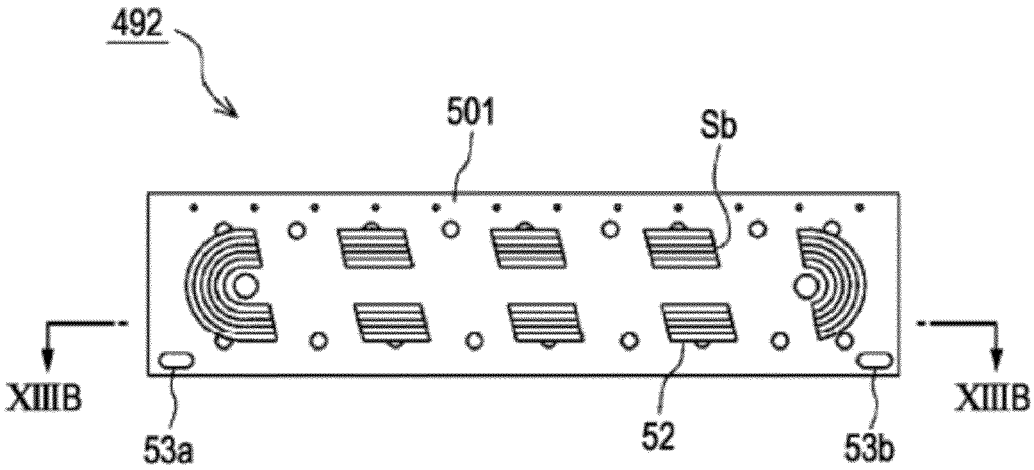
FIGS. 13A and 13B are respectively a front view showing a configuration example of a voice coil unit according to a second embodiment, and a cross-sectional view taken along the arrow XIIIB-XIIIB thereof.
Figure 13B:
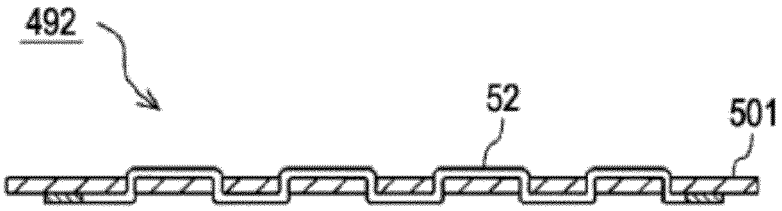

FIGS. 13A and 13B are respectively a front view showing a configuration example of a voice coil unit 492 according to a second embodiment, and a cross-sectional view taken along the arrow XIIIB-XIIIB thereof. The planar-type voice coil unit 492 shown in FIG. 13A can be applied to the speaker 100. The voice coil section 52 shown in FIG. 13A has a coil member wound in a planar track shape and disposed so as to extend through the rectangular bobbin section 51 from one side to the other side and from the other side to the one side.

Figure 14A:
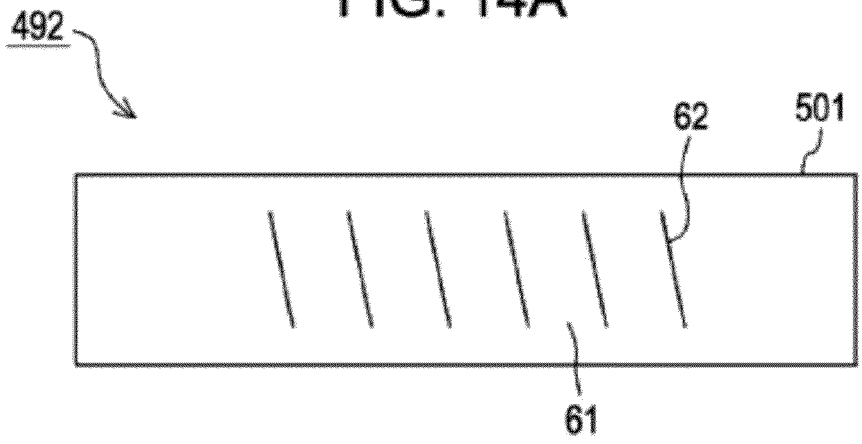
FIGS. 14A to 14C are each a process drawing showing a formation example of the voice coil unit.
Figure 14B:
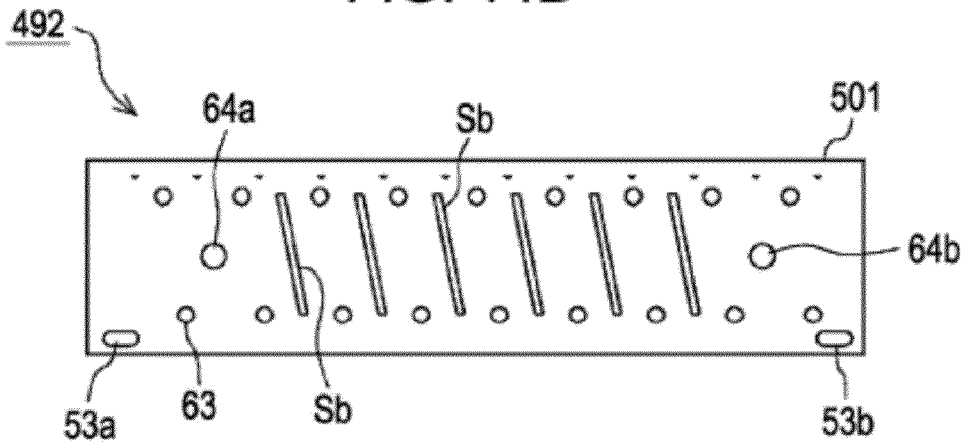
Figure 14C:
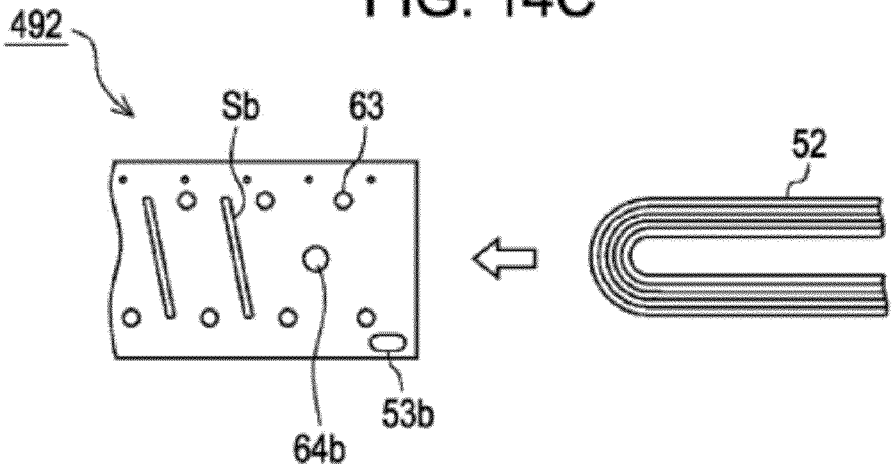

For example, a plurality of slits Sb are provided in the rectangular bobbin section 51, and the voice coil section 52 is disposed so as to weave alternately in and out of the slits Sb from one side to the other side of the rectangular bobbin section 51 as shown in FIG. 13B (see FIG. 14C). Since the materials and sizes of the voice coil section 52, the rectangular bobbin section 51, and the like of the voice coil unit 492 are the same as those in the first embodiment, description thereof is omitted.

FIGS. 14A to 14C are each a process drawing showing a formation example of the voice coil unit 492. In this example as well, one shown in FIG. 9 is used as the voice coil section 52. First, a rectangular bobbin section 501 as shown in FIG. 14A is formed. Although the rectangular bobbin section 501 may simply have slits cut in a slanted fashion in a bobbin member, it is preferable to fabricate and use the rectangular bobbin section 501 having slanted irregularities similar to the rectangular bobbin section 51 having an irregular shape as shown in FIG. 11.

The rectangular bobbin section 501 having slanted irregularities mentioned above is formed in such a way that a bobbin member made of sheet-like polycarbonate or the like is extrusion molded in a slanted fashion, and obliquely projecting portions are formed on the front and back, thereby increasing the strength of the rectangular bobbin section 501 itself. Each stepped portion due to the extrusion molding serves as a part where the voice coil section 52 is made to cross the rectangular bobbin section 501. In this example as well, the rectangular bobbin section 501 has the projections 61 and the depressions 62 as shown in FIG. 11. The steps formed by the projections 61 and the depressions 62 are set smaller than or equal to the wire diameter of the voice coil section 52 shown in FIG. 9.

Next, the bobbin member is punched to form the rectangular bobbin section 501 as shown in FIG. 14B. At this time, a plurality of slanted rectangular slits Sb, the plurality of joining through-holes 63, and the coil-positioning holes 64*a* and 64*b*, and further, the lead-out terminals 53*a* and 53*b* are formed in the bobbin member. In this example, the number of the slanted slits Sb is six. Of course, the number of the slits Sb may be increased to eight in total by adding one more slit Sb on either side. The slits Sb are bored so as to be obliquely cross the longitudinal direction of the rectangular bobbin section 501.

As in the first embodiment, the holes 64*a* and 64*b* are preferably bored in alignment with substantially the center position of the curved portion of the voice coil section 52. In this example as well, as in the first embodiment, the rectangular bobbin section 501 has nine through-holes 63 formed in vertical rows at positions that overlap the points where the voice coil section 52 having a planar track shape is bonded. As in the first embodiment, the terminals 53*a* and 53*b* are each formed by, for example, affixing a copper foil cut out in a track (elongate hole) shape with an adhesive.

Once the above-described rectangular bobbin section 501 is successfully formed, the voice coil section 52 shown in FIG. 14C is disposed so as to weave alternately through the rectangular bobbin section 501 having the slanted slits Sb. As the voice coil section 52, one formed from the single winding track shown in FIG. 9 and having a coil member wound in a planar track shape is used. Since the method of forming the voice coil unit 492 is otherwise the same as that in the first embodiment, description thereof is omitted. The voice coil unit 492 is thus completed.

In this way, with the voice coil unit 492 and its manufacturing method according to the second embodiment, the voice coil unit 492 is provided which is placed so as to pass through substantially the center of the magnetic gaps g2 and g3 and is coupled to the diaphragm 31 at its one end. The voice coil unit 492 has the voice coil section 52 having a coil member wound in a planar track shape and disposed so as to extend through the rectangular bobbin section 501 having the slanted slits Sb from one side to the other side and from the other side to the one side.

Therefore, thermal deformation due to the bimetal phenomenon that results from a difference between the thermal expansion coefficient of the coil member and the thermal expansion coefficient of the rectangular bobbin section 501 can be cancelled out between one side and the other side of the rectangular bobbin section 501, thereby making it possible to maintain the planarity of the rectangular bobbin section 501. Thus, as in the first embodiment, since the rectangular bobbin section 501 is pulled not from one side but alternately from both sides due to thermal expansion, there is a relatively small amount of deformation, and there is less peeling or less rubbing of the voice coil section 52 within the magnetic gaps g2 and g3, leading to an improvement in the input tolerance of the planar-type voice coil unit 492.

Embodiment 3

Figure 15A:
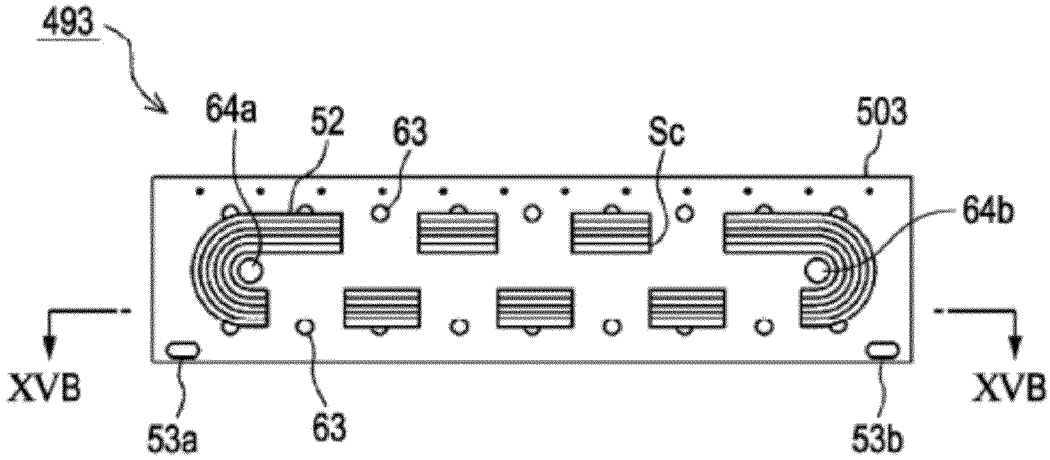
FIGS. 15A and 15B are respectively a front view showing a configuration example of a voice coil unit according to a third embodiment, and a cross-sectional view taken along the arrow XVB-XVB thereof.
Figure 15B:
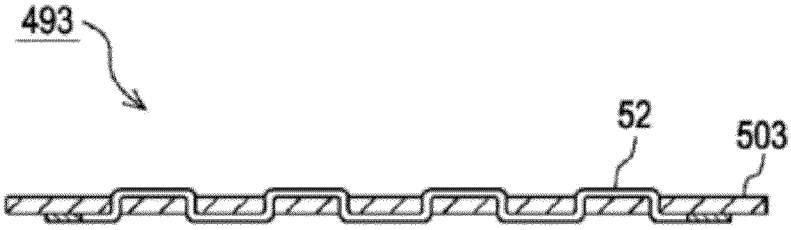

FIGS. 15A and 15B are respectively a front view showing a configuration example of a voice coil unit 493 according to a third embodiment, and a cross-sectional view taken along the arrow XVB-XVB thereof.

The voice coil unit 493 shown in FIG. 15A has the voice coil section 52 disposed in a staggered grid-like fashion so as to weave in and out of a plurality of slits Sc in a rectangular bobbin section 503.

According to the above voice coil unit 493, the number of irregularities produced by the voice coil section 52 disposed so as to weave in and out of the plurality of slits Sc differs between one side and the other side of the rectangular bobbin section 503. In this example, the number of irregularities produced by the voice coil section 52 is three in the upper stage and four in the lower stage.

When the voice coil unit 493 is configured in this way, the winding start point and winding end point of the coil member can be drawn out to one side of the rectangular bobbin section 503, so the tinsel wires 54*a* and 54*b* of the voice coil section 52 can be connected on one side of the rectangular bobbin section 503, thereby making it possible to enhance the workability in terms of mounting of the speaker 100 or the like.

Figure 16A:
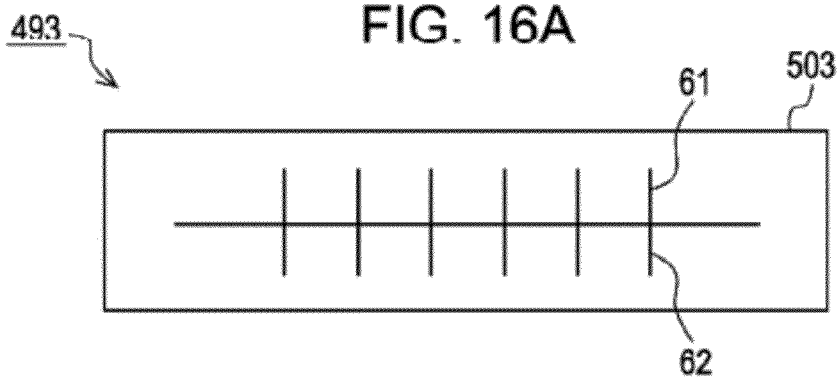
FIGS. 16A to 16C are each a process drawing showing a formation example of the voice coil unit.
Figure 16B:
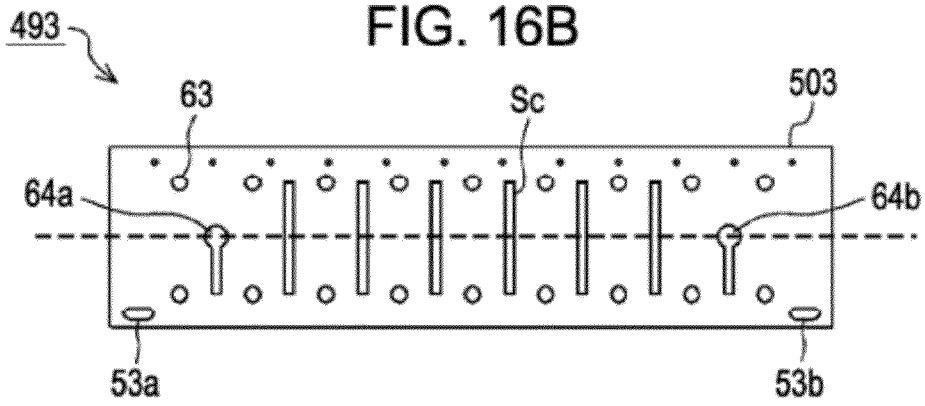
Figure 16C:
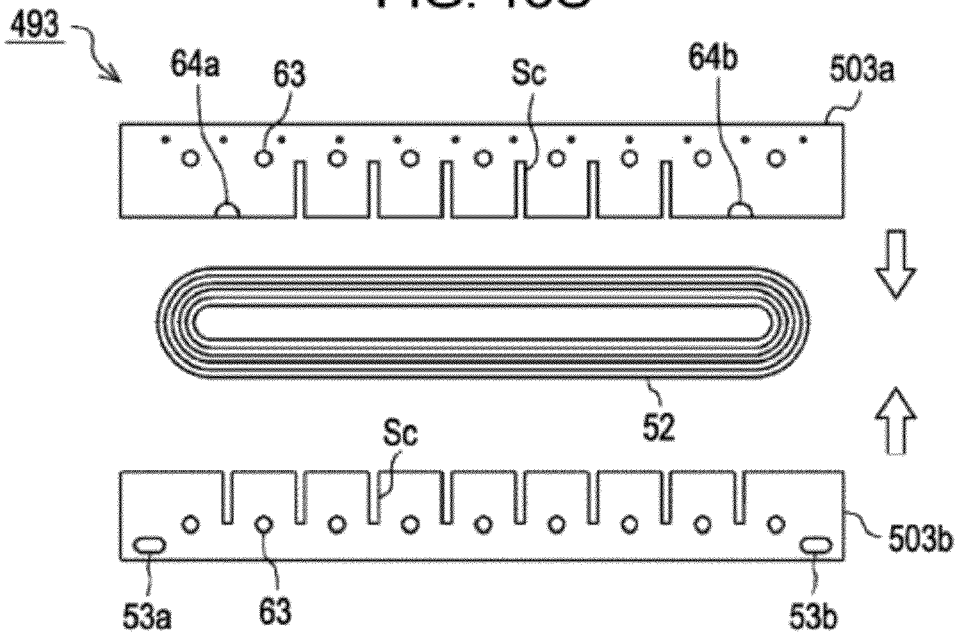

FIGS. 16A to 16C are each a process drawing showing a formation example of the voice coil unit 493. In this example as well, one shown in FIG. 9 is used as the voice coil section 52. First, the rectangular bobbin section 503 as shown in FIG. 16A is formed. Although the rectangular bobbin section 503 may simply have a plurality of slits cut in a bobbin member, it is preferable to fabricate and use the rectangular bobbin section 503 having slanted irregularities similar to the rectangular bobbin section 51 having an irregular shape as shown in FIG. 11.

The rectangular bobbin section 503 having irregularities mentioned above is formed in such a way that a bobbin member made of sheet-like polycarbonate or the like is extrusion molded in a staggered grid-like shape, and staggered grid-like projections are formed on the front and back, thereby increasing the strength of the rectangular bobbin section 503 itself. Each stepped portion due to the extrusion molding serves as a part where the voice coil section 52 is made to cross the rectangular bobbin section 503. In this example as well, the rectangular bobbin section 503 has the projections 61 and the depressions 62 as shown in FIG. 11. The steps formed by the projections 61 and the depressions 62 are set smaller than or equal to the wire diameter of the voice coil section 52 shown in FIG. 9.

Next, the bobbin member is punched to form the rectangular bobbin section 503 as shown in FIG. 16B. At this time, a plurality of staggered grid-like slits Sc, the plurality of joining through-holes 63, and the coil-positioning holes 64*a* and 64*b*, and further, the lead-out terminals 53*a* and 53*b* are formed in the bobbin member. In this example, the number of the staggered grid-like slits Sc is six. Of course, the number of the slits Sc may be increased to eight in total by adding one more slit Sc on either side. The slits Sc are bored so as to be orthogonal to the longitudinal direction of the rectangular bobbin section 503.

As in the first and second embodiments, the holes 64*a* and 64*b* are preferably bored in alignment with substantially the center position of the curved portion of the voice coil section 52. In this example as well, as in the first and second embodiments, the rectangular bobbin section 503 has nine through-holes 63 formed in vertical rows at positions that overlap the points where the voice coil section 52 having a planar track shape is bonded. As in the first and second embodiments, the terminals 53*a* and 53*b* are each formed by, for example, affixing a copper foil cut out in a track (elongate hole) shape with an adhesive.

Once the above-described rectangular bobbin section 503 is successfully formed, to facilitate insertion of the voice coil section 52, the rectangular bobbin section 503 is split into upper and lower portions at the position indicated by the broken line in the drawing. For example, the rectangular bobbin section 503 is split into an upper comb tooth-shaped rectangular bobbin section 503*a*, and a lower comb tooth-shaped rectangular bobbin section 503*b*. The slits Sc are also split between the upper rectangular bobbin section 503*a*, and the lower rectangular bobbin section 503*b*. Thus, rectangular bobbin sections 503*a* and 503*b* having a pair of a plurality of slits Sc having a comb-tooth shape are obtained. In this example, the number of comb tooth-shaped parts is five.

Once such a pair of rectangular bobbin sections 503*a* and 503*b* are successfully formed, in the rectangular bobbin sections 503*a* and 503*b* shown in FIG. 16C, the pair of comb tooth-shaped slits Sc are opposed to each other, and the voice coil section 52 is inserted and passed through the mutually opposed comb tooth-shaped slits Sc alternately in a staggered grid-like fashion. Thus, the voice coil section 52 can be disposed so as to weave alternately through the rectangular bobbin section 503 having the staggered grid-like slits Sc.

In this example as well, as the voice coil section 52, one formed from the single winding track shown in FIG. 9 and having a coil member wound in a planar track shape is used. The portions where the comb tooth-shaped slits Sc are opposed to each other are bonded together with an adhesive, followed by heat treatment with the mold clamping jig 400, thus integrating together the rectangular bobbin sections 503*a* and 503*b* split into the upper and lower portions. Since the method of forming the voice coil unit 493 is otherwise the same as that in the first and second embodiments, description thereof is omitted. The voice coil unit 493 is thus completed.

In this way, with the voice coil unit 493 and its manufacturing method according to the third embodiment, the voice coil unit 493 is provided which is placed so as to pass through substantially the center of the magnetic gaps g2 and g3 and is coupled to the diaphragm 31 at its one end. The voice coil unit 493 has the voice coil section 52 having a coil member wound in a planar track shape and disposed so as to weave through the rectangular bobbin section 503 having the staggered grid-like slits Sc from one side to the other side and from the other side to the one side.

Therefore, thermal deformation due to the bimetal phenomenon that results from a difference between the thermal expansion coefficient of the coil member and the thermal expansion coefficient of the rectangular bobbin section 503 can be cancelled out between one side and the other side of the rectangular bobbin section 503, thereby making it possible to maintain the planarity of the rectangular bobbin section 503. Thus, as in the first and second embodiments, since the rectangular bobbin section 503 is pulled not from one side but alternately from both sides due to thermal expansion, there is a relatively small amount of deformation, and there is less peeling or less rubbing of the voice coil section 52 within the magnetic gaps g2 and g3, leading to an improvement in the input tolerance of the planar-type voice coil unit 493.

Embodiment 4

Figure 17:
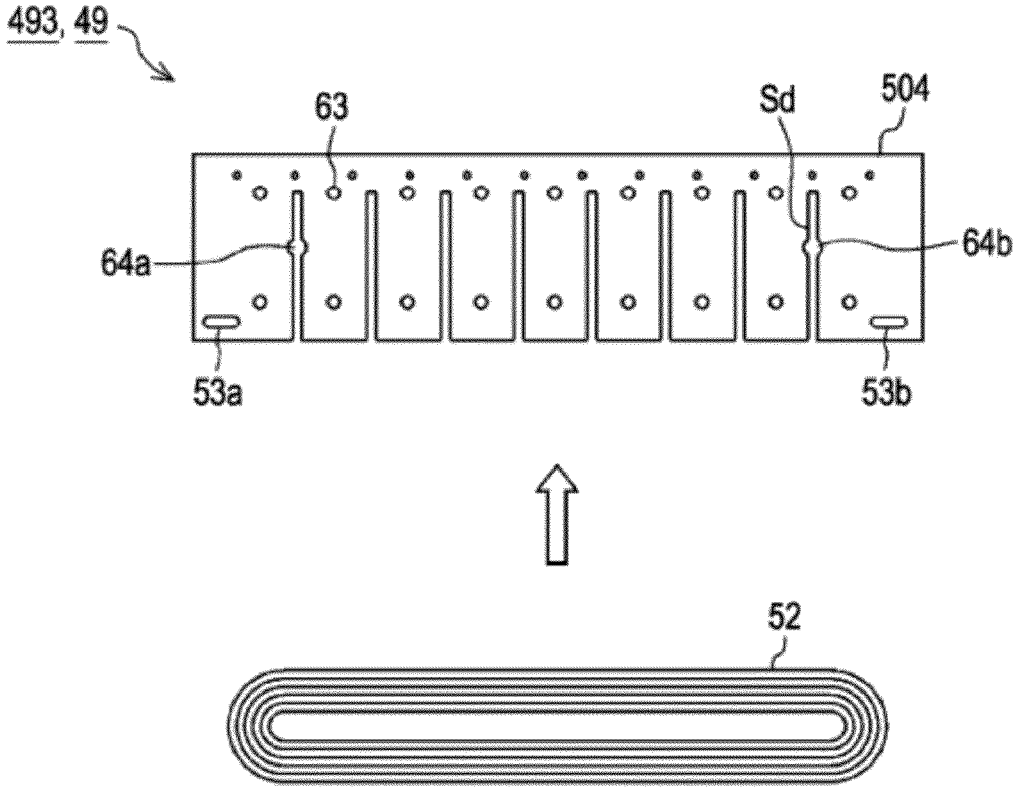
FIG. 17 is a front view showing a configuration example of a rectangular bobbin section and a mounting example of the voice coil section according to a fourth embodiment.

FIG. 17 is a front view showing a configuration example of a rectangular bobbin section 504 and a mounting example of the voice coil section 52 according to a fourth embodiment. The rectangular bobbin section 504 shown in FIG. 17 is provided with a plurality of comb tooth-shaped slits Sd. The slits Sd are cut from one side to the other side of the rectangular bobbin section 504. In this example, the cut is stopped at a point where the cut extends substantially four fifths of the distance from an end portion of the rectangular bobbin section 504.

Thereafter, the voice coil section 52 is inserted and passed so as to weave alternately in and out of the comb tooth-shaped slits Sd. In this way, according to the fourth embodiment, the staggered grid-like voice coil unit 493 shown in FIGS. 15A and 15B, the voice coil unit 49 shown in FIGS. 3A and 3B, or the like can be obtained also by mounting the voice coil section 52 to the rectangular bobbin section 504.

Embodiment 5

Figure 18:
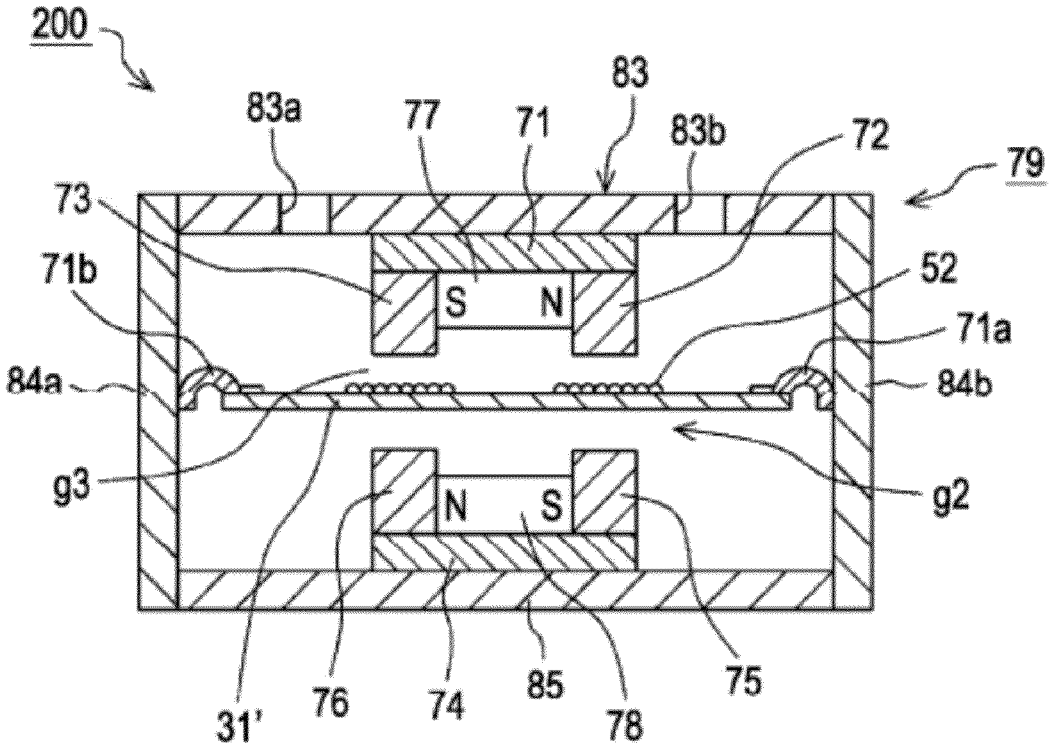
FIG. 18 is a cross-sectional view showing a configuration example of a speaker according to a fifth embodiment.

FIG. 18 is a cross-sectional view showing a configuration example of a speaker 200 according to a fifth embodiment. The speaker 200 shown in FIG. 18 is a leaf speaker in which the voice coil section 52 is directly affixed to a diaphragm 31'. In the first to fourth embodiments, the voice coil unit 49, 492, 493, or the like is attached perpendicularly to the diaphragm 31. In contrast, in the fifth embodiment, the voice coil section 52 is directly affixed to the vibrating surface of the diaphragm 31' on the same plane. This configuration can also provide the slim-type speaker 200.

The speaker 200 includes a voice coil unit 79 attached movably inside a casing assembled from a lid section 83, frames 84*a* and 84*b*, and a base section 85. The voice coil unit 79 includes, for example, the diaphragm 31' having the voice coil section 52 directly affixed to the vibrating surface having a track shape.

In this example, the lid section 83 has a rectangular shape, and sound-leak openings 83*a* and 83*b* are provided n the lid section 83. An upper plate 71 is bonded to the back side of the lid section 83. An upper right plate 72 and an upper left plate 73 are provided on opposite sides of the upper plate 71. The upper right plate 72 and the upper left plate 73 are bonded to the upper plate 71 while holding an upper magnet 77.

A lower plate 74 is bonded to the upper surface of the base section 85. A lower right plate 75 and a lower left plate 76 are provided on the lower plate 74. The lower right plate 75 and the lower left plate 76 are bonded to the lower plate 74 while holding a lower magnet 78. The above-described voice coil unit 79 is placed between the magnetic gaps g2 and g3 formed by the magnet 77 and the magnet 78. The opposite end portions of the voice coil unit 79 are attached to the frames 84*a* and 84*b*. The speaker 200 is thus configured.

Figure 19:
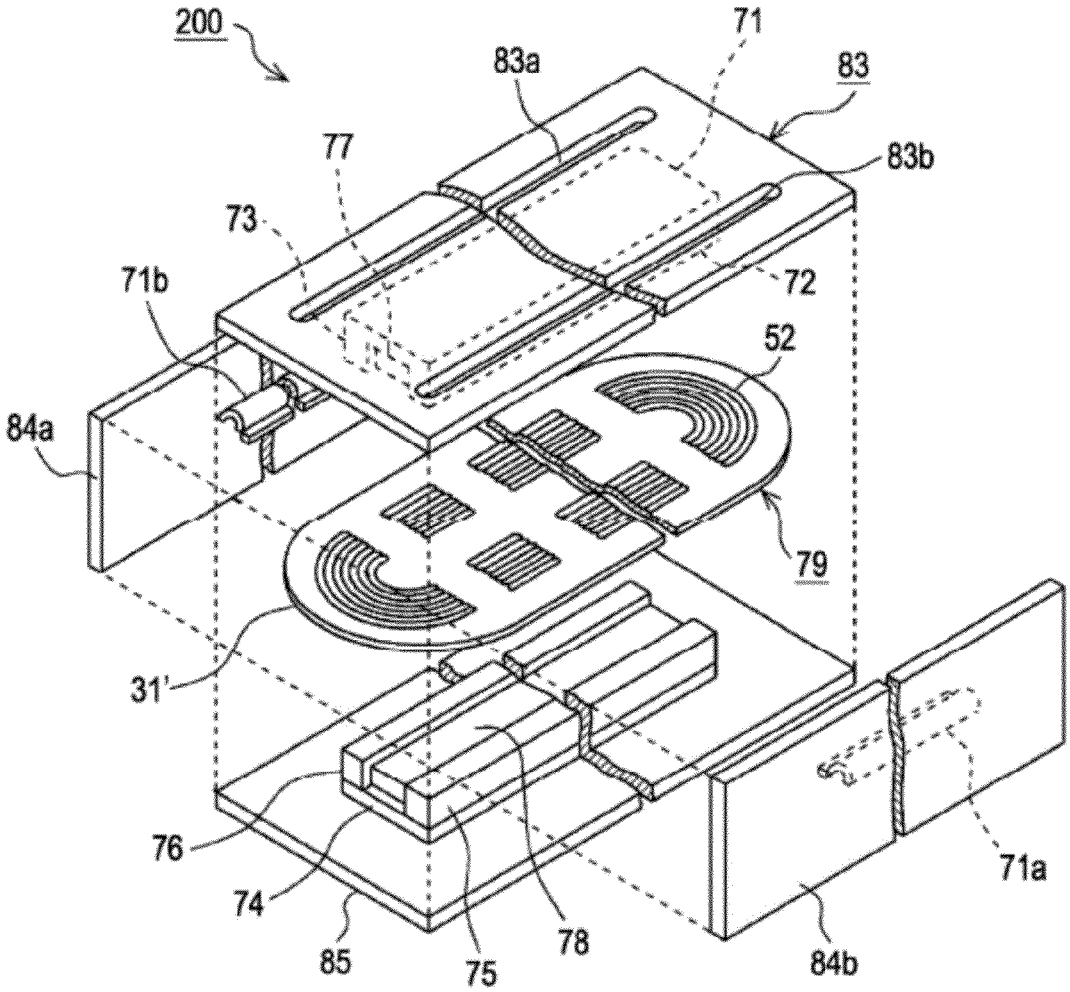
FIG. 19 is an exploded perspective view showing an assembly example of the speaker.

Next, an assembly example of the speaker 200 will be described. FIG. 19 is an exploded perspective view showing an assembly example of the speaker 200. First, the voice coil section 52 is joined to the diaphragm 31' to obtain the voice coil unit 79 in a leaf shape. The diaphragm 31' is formed from, for example, a foamed mica material in a flat shape. As the voice coil unit 79, one having the structure of the voice coil unit 49 described with reference to the first embodiment is used. Of course, the voice coil unit 79 used may be one obtained by applying the structure of the voice coil unit 492 in the slanted configuration, the voice coil unit 493 in the staggered grid-like configuration, and the like described with reference to the second to fourth embodiments.

Meanwhile, the upper plate 71, the upper right plate 72, the upper left plate 73, and the upper magnet 77 are attached to the lid section 83. The upper right plate 72 and the upper left plate 73 are affixed and attached onto the back side of the upper plate 71, and the magnet 77 is attached between the upper left plate 73 and the upper right plate 72. The magnet 77 is sandwiched by the upper left plate 73 and the upper right plate 72 and fixed with an adhesive. At this time, the magnet 77 is placed in such a way that its N pole faces the upper right plate 72.

On the other hand, the lower plate 74, the lower right plate 75, the lower left plate 76, and the lower magnet 78 are attached to the base section 85. The lower right plate 75 and the lower left plate 76 are affixed and attached onto the front side of the lower plate 74, and the magnet 78 is attached between the lower left plate 76 and the lower right plate 75. The magnet 78 is sandwiched by the lower left plate 76 and the lower right plate 75 and fixed with an adhesive. At this time, the magnet 78 is placed in such a way that its N pole faces the lower left plate 76.

Then, the frame 84*a* and the frame 84*b* are attached to the opposite sides of the base section 85 to which the lower plate 74, the lower right plate 75, the lower left plate 76, and the lower magnet 78 have been attached. Thereafter, the voice coil unit 79 is attached to the frame 84*a* and the frame 84*b*. In this example, the voice coil unit 79 attached on the diaphragm 31' is attached movably while maintaining the magnetic gap g2 (see FIG. 18). For example, edges 71*a* and 71*b* are provided inside the frame 84*a* and the frame 84*b*, respectively. The diaphragm 31' is attached to the frame 84*a* and the frame 84*b* via its opposite end portions and the edges 71*a* and 71*b*.

Thereafter, the lid section 83 on which the upper plate 71, the upper right plate 72, the upper left plate 73, and the upper magnet 77 are provided is attached to an upper portion of the frame 84*a* and an upper portion of the frame 84*b*. At this time, the voice coil unit 79 attached on the diaphragm 31' is attached movably while maintaining the magnetic gap g3 (see FIG. 18). When the speaker 200 is configured in this way, the voice coil unit 79 can be made movable vertically between the magnetic gaps g2 and g3. The slim-type speaker 200 as shown in FIG. 17 is thus completed.

In this way, the speaker 200 according to the fifth embodiment includes the voice coil unit 79 that is placed so as to pass through substantially the center of the magnetic gaps g2 and g3 and whose coil member is directly placed on the diaphragm 31'. The voice coil unit 79 has the voice coil section 52 having a coil member wound in a planar track shape and disposed so as to extend through the track-shaped diaphragm 31' from one side to the other side and from the other side to the one side.

Therefore, thermal deformation due to the bimetal phenomenon that results from a difference between the thermal expansion coefficient of the coil member and the thermal expansion coefficient of the diaphragm 31' can be cancelled out between one side and the other side of the diaphragm 31', thereby making it possible to maintain the planarity or cone shape of the diaphragm 31'. Thus, since the diaphragm 31' is pulled not from one side but alternately from both sides due to thermal expansion, there is a relatively small amount of deformation, and there is less peeling or less rubbing of the voice coil section 52 within the magnetic gaps g2 and g3, leading to an improvement in the input tolerance of the planar-type voice coil unit 79.

The present application contains subject matter related to that disclosed in Japanese Priority Patent Application JP 2008-106179 filed in the Japan Patent Office on Apr. 15, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A speaker comprising:

a magnetic circuit forming a slit-like magnetic gap;

a frame that houses and holds the magnetic circuit;

a diaphragm attached to the frame so as to be capable of vibrating;

a voice coil unit that is placed so as to pass through substantially the center of the magnetic gap, and has its one end coupled to the diaphragm; and a damper attached to the frame to support an other end of the voice coil unit, wherein the voice coil unit has a planar-type coil bobbin section, a voice coil section having a coil member wound in a planar track shape and disposed so as to extend through the coil bobbin section from one side to another side and from the other side to the one side;

wherein the planar-type coil bobbin section has a plurality of slits; and the voice coil section is disposed so as to weave alternately in and out of the slits from the one side of the coil bobbin section to the other side; and wherein the number of irregularities produced by the voice coil section differs between the one side and the other side of the coil bobbin section.

2. The speaker according to claim 1, wherein:

the plurality of slits are provided in a slanted fashion; and the voice coil section is disposed so as to weave alternately in and out of the slanted slits.

3. The speaker according to claim 1, wherein:

the plurality of slits are provided in a staggered grid-like fashion; and the voice coil section is disposed so as to weave alternately in and out of the staggered grid-like slits.

4. The speaker according to claim 1, wherein:

the planar-type coil bobbin section has a plurality of slits having a rectangular shape; and the voice coil section is passed so as to be inserted alternately into the rectangular slits.

5. The speaker according to claim 1, wherein:

the planar-type coil bobbin section has a pair of a plurality of slits having a comb-tooth shape;

the pair of comb tooth-shaped slits are opposed to each other; and the voice coil section is passed so as to be inserted alternately into the comb tooth-shaped slits opposed to each other.

6. The speaker according to claim 1, wherein:

the planar-type coil bobbin section has a plurality of slits having a comb-tooth shape; and the voice coil section is passed so as to be inserted alternately into the comb tooth-shaped slits.

* * * * *